US010253740B2

(12) United States Patent
Noguchi

(10) Patent No.: US 10,253,740 B2
(45) Date of Patent: Apr. 9, 2019

(54) FUEL INJECTION DEVICE NOZZLE PLATE

(71) Applicant: ENPLAS CORPORATION, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 0 days.

(21) Appl. No.: 15/126,038

(22) PCT Filed: Feb. 5, 2015

(86) PCT No.: PCT/JP2015/053172
§ 371 (c)(1),
(2) Date: Sep. 14, 2016

(87) PCT Pub. No.: WO2015/141316
PCT Pub. Date: Sep. 24, 2015

(65) Prior Publication Data

US 2017/0089313 A1 Mar. 30, 2017

(30) Foreign Application Priority Data

Mar. 18, 2014 (JP) ..... 2014-054311

(51) Int. Cl.
*F02M 61/18* (2006.01)
*F02M 61/16* (2006.01)
(Continued)

(52) U.S. Cl.
CPC ..... *F02M 61/186* (2013.01); *F02M 61/162* (2013.01); *F02M 61/1813* (2013.01);
(Continued)

(58) Field of Classification Search
CPC ..... F02M 61/16; F02M 61/168; F02M 61/18; F02M 61/1818; F02M 61/186;
(Continued)

(56) References Cited

U.S. PATENT DOCUMENTS 3,741,704 A * 6/1973 Beasley ..... B29C 45/27 425/550
4,186,708 A * 2/1980 Bowler ..... F02M 51/061 123/445
(Continued)

FOREIGN PATENT DOCUMENTS

JP 1-100366 4/1989
JP 5-44539 4/1993
(Continued)

OTHER PUBLICATIONS

JP 2002-115627A English Translation Version.*

*Primary Examiner* — Hung Q Nguyen
*Assistant Examiner* — Johnny H Hoang
(74) *Attorney, Agent, or Firm* — Wenderoth, Lind & Ponack, L.L.P.

(57) ABSTRACT

A nozzle plate is to be attached to a fuel injection port of a fuel injection device and injects fuel from the fuel injection port into an intake pipe through nozzle holes. The outlet side openings of the nozzle holes are partially blocked by interference bodies to determine the fuel injection directions and form orifices for reducing flows of the fuel at the outlet side openings. The plurality of orifices have different fuel injection directions, fuel fine particles in sprays draw ambient air, and the drawn air is provided with kinetic momentum to generate a spiral air flow. The nozzle plate is formed by cooling and solidifying molten resin having filled the cavity of a die.

14 Claims, 15 Drawing Sheets

(51) Int. Cl.
*F02M 69/04* (2006.01)
*F02M 51/08* (2006.01)

(52) U.S. Cl.
CPC ..... *F02M 61/1853* (2013.01); *F02M 69/044* (2013.01); *F02M 61/1886* (2013.01); *F02M 2051/08* (2013.01)

(58) Field of Classification Search
CPC ..... F02M 61/1826; F02M 61/1833; F02M 51/06; F02M 69/044
USPC ..... 123/445, 469–471
See application file for complete search history.

(56) References Cited

U.S. PATENT DOCUMENTS

| | | | | |
|---|---|---|---|---|
| 2003/0070659 | A1 | 4/2003 | Kihara et al. | |
| 2013/0026256 | A1* | 1/2013 | Okamoto | F02M 61/186 239/487 |
| 2015/0021416 | A1* | 1/2015 | Raney | F02M 61/1806 239/558 |
| 2015/0204291 | A1* | 7/2015 | Schnobrich | F02M 61/184 239/584 |
| 2015/0211461 | A1* | 7/2015 | Shirk | F02M 61/1833 239/557 |
| 2016/0025052 | A1* | 1/2016 | Yasukawa | F02M 51/0671 239/585.1 |

FOREIGN PATENT DOCUMENTS

| | | |
|---|---|---|
| JP | 2002-115627 | 4/2002 |
| JP | 3860454 | 9/2006 |
| WO | 2014/024292 | 2/2014 |

* cited by examiner

P1
P2
P3
P4
P5
V1
V2
V3
V4
RA
RB
F1
F2
B4
B5
C1
13
13A
13B
14
15
16
18
20
24
37
38(34)
40
P1,P2
P3,P4
P1,P4
P2,P3
X
Y
Z

P1
P2
P3
P4
P5'
P1,P2
P3,P4
P1,P4
P2,P3
V1
V2
V3
V4
RA
RB
F3
F4
B7
B8
C1
X
Y
Z
7
13
13'
13A
13B
14
15
16
18
20
24
37
38(34)
40

FUEL INJECTION DEVICE NOZZLE PLATE

TECHNICAL FIELD

The present invention relates to a fuel injection device nozzle plate to be attached to a fuel injection port of a fuel injection device and atomizing and injecting fuel flowing from the fuel injection port.

BACKGROUND ART

An internal combustion engine (abbreviated below as an engine) of an automobile or the like mixes fuel injected from a fuel injection device and air introduced via an intake pipe to generate a combustible gas mixture and burns the combustible gas mixture in the cylinder. It is known that the mixture state of fuel injected from the fuel injection device and air significantly affects the performance of this type of engine and, in particular, the atomization of fuel injected from the fuel injection device is an important factor governing the performance of the engine.

For example, a nozzle plate 1000 illustrated in FIG. 15 can be attached to the front end side of a valve body 1003 via a nozzle holder 1004 so as to cover a fuel injection port 1002 of a fuel injection device 1001 for a 4-valve engine. The nozzle plate 1000 introduces fuel injected from the fuel injection port 1002 to a pair of inflow holes 1005 and 1005 for branching in two directions and outflow holes 1006 and 1006 communicating with the inflow holes 1005 and 1005, turns the fuel having flowed to the outflow holes 1006 and 1006 using spiral grooves 1007 formed in the outflow holes 1006 and 1006, and injects the turning fuel into an intake pipe from blowout ports 1008 and 1008, thereby promoting the atomization of the fuel in the spray.

In addition, the nozzle plate 1000 illustrated in FIG. 15 can make the spray flow to two intake valves by setting the injection angle of the fuel as appropriate based on the ratio between the inner diameter and depth of the blowout ports 1008 (see JP-UM-B-5-44539).

However, the nozzle plate 1000 illustrated in FIG. 15 is made of metal such as stainless steel, the inflow holes 1005 need to be formed (by mechanical machining such as cutting, discharge machining, laser machining, or the like) separately from the outflow holes 1006 and the blowout ports 1008 having an inclination angle different from that of the inflow holes 1005, and the spiral grooves 1007 need to be machined in the outflow holes 1006 having a small inner diameter. Accordingly, the nozzle plate 1000 illustrated in FIG. 15 has difficulty in machining and the production cost increases.

Therefore, the invention provides a fuel injection device nozzle plate that can easily change the fuel injection direction to a desired direction and has reduced production cost.

Solution to Problem

The invention relates to a fuel injection device nozzle plate 7 that is to be attached to a fuel injection port 8 of a fuel injection device 1, has a plurality of nozzle holes 12 through which fuel injected from the fuel injection port 8 passes, the plurality of nozzle holes 12 facing the fuel injection port 8, and injects the fuel from the fuel injection port 8 into an intake pipe 2 through the plurality of nozzle holes 12, as illustrated in FIG. 1 to FIG. 14. In the invention, the plurality of nozzle holes 12 are formed in portions facing the fuel injection port 8, outlet side openings 26 for injecting the fuel are partially blocked by interference bodies 22 or 52 to determine injection directions of the fuel and form a plurality of orifices 13 or 53 for reducing flows of the fuel at the outlet side openings 26. In addition, the plurality of orifices 13 or 53 individually have different fuel injection directions and sprays from the orifices 13 or 53 adjacent to each other interact with each other to generate a helical air flow. The portions facing the fuel injection port 8, the nozzle holes 12, and the interference bodies 22 or 52 are formed by cooling and solidifying molten resin having filled a cavity 46 or 66 of a die 41 or 61.

Advantageous Effects of Invention

According to the invention, the fuel injection direction from the orifices is determined by how the outlet side openings of the nozzle holes are blocked and the portions facing the fuel injection port, the nozzle holes, and the interference bodies are formed by cooling and solidifying molten resin having filled the cavity of the die. Therefore, the nozzle holes and orifices do not need to be machined to complicated shapes by machining or the like, manufacturing man-hours of the fuel injection device nozzle plate can be reduced, and the production cost of the fuel injection device nozzle plate can be reduced.

BRIEF DESCRIPTION OF DRAWINGS

FIG. 2(*a*) is a vertical cross sectional view (cross sectional view taken along line B1-B1 in FIG. 2) illustrating the front end side of the fuel injection device. FIG. 2(*b*) is a bottom view (diagram illustrating the front end surface of the fuel injection device seen from direction A1 in FIG. 2(*a*)) illustrating the front end side of the fuel injection device.

FIG. 3(*a*) is a front view illustrating the nozzle plate, FIG. 3(*b*) is a cross sectional view illustrating the nozzle plate taken along line B2-B2 in FIG. 3(*a*), and FIG. 3(*c*) is a back view illustrating the nozzle plate.

FIG. 4(*a*) is an enlarged view illustrating a part (a nozzle hole formation concave portion) of the nozzle plate in FIG. 3(*a*), FIG. 4(*b*) is a partial enlarged view illustrating the nozzle hole and the vicinity thereof, and FIG. 4(*c*) is an enlarged cross sectional view taken along line B3-B3 in FIG. 4(*b*).

FIG. 5(*a*) is a plan view of the nozzle plate illustrating the fuel injection state, FIG. 5(*b*) is a cross sectional view taken along line B4-B4 in FIG. 5(*a*), FIG. 5(*c*) is a cross sectional view taken along line B5-B5 in FIG. 5(*a*), FIG. 5(*d*) illustrates the fuel injection state when a virtual plane is seen along the direction indicated by arrow F1, and FIG. 5(*e*) illustrates the fuel injection state when the virtual plane is seen along the direction indicated by arrow F2.

FIG. 6(*a*) is a vertical cross sectional view illustrating the injection molding die and FIG. 6(*b*) is a plan view illustrating the cavity inner plane of a first die against which a nozzle hole formation pin abuts.

FIG. 7(*a*) is a front view illustrating the nozzle plate and this drawing corresponds to FIG. 3(*a*).

FIG. 7(*b*) is a diagram taken along line B6-B6 in FIG. 7(*a*). FIG. 7(*c*) is a back view illustrating the nozzle plate.

FIG. 8(*a*) is a plan view of the nozzle plate illustrating the fuel injection state, FIG. 8(*b*) is a cross sectional view taken along line B7-B7 in FIG. 8(*a*), FIG. 8(*c*) is a cross sectional view taken along line B8-B8 in FIG. 8(*a*), FIG. 8(*d*) illustrates the fuel injection state when the virtual plane is seen along the direction indicated by arrow F3, and FIG. 8(*e*) illustrates the fuel injection state when the virtual plane is seen along the direction indicated by arrow F4.

FIG. 9(*a*) is a front view illustrating the nozzle plate, FIG. 9(*b*) is a cross sectional view illustrating the nozzle plate taken along line B9-B9 in FIG. 9(*a*), and FIG. 9(*c*) is a back view illustrating the nozzle plate.

FIG. 10(*a*) is an enlarged view illustrating a part (the nozzle hole formation concave portions) of the nozzle plate in FIG. 9(*a*), FIG. 10(*b*) is a partial enlarged view of the nozzle plate illustrating the nozzle hole and the vicinity thereof, FIG. 10(*c*) is an enlarged cross sectional view taken along line B10-B10 in FIG. 10(*b*), FIG. 10(*d*) is an enlarged view illustrating part D1 in FIG. 10(*b*), and FIG. 10(*e*) is an enlarged view illustrating part D2 in FIG. 10(*b*).

FIG. 11(*a*) is a plan view of the nozzle plate illustrating the fuel injection state, FIG. 11(*b*) is a cross sectional view taken along line B11-B11 in FIG. 11(*a*), FIG. 11(*c*) is a cross sectional view taken along line B12-B12 in FIG. 11(*a*), FIG. 11(*d*) illustrates the fuel injection state when the virtual plane is seen along the direction indicated by arrow F5, and FIG. 11(*e*) illustrates the fuel injection state when the virtual plane is seen along the direction indicated by arrow F6.

FIG. 12(*a*) is a virtual cross sectional view illustrating the injection molding die, FIG. 12(*b*) is an enlarged view illustrating a part in FIG. 12(*a*), and FIG. 12(*c*) is a plan view illustrating the cavity inner plane of the first die against which a nozzle hole formation pin abuts.

FIG. 13(*a*) is a front view illustrating the nozzle plate and this drawing corresponds to FIG. 9(*a*), FIG. 13(*b*) is a diagram taken along line B13-B13 in FIG. 13(*a*), and FIG. 13(*c*) is a back view illustrating the nozzle plate.

FIG. 14(*a*) is a plan view of the nozzle plate illustrating the fuel injection state, FIG. 14(*b*) is a cross sectional view taken along line B14-B14 in FIG. 14(*a*), FIG. 14(*c*) is a cross sectional view taken along line B15-B15 in FIG. 14(*a*), FIG. 14(*d*) illustrates the fuel injection state when the virtual plane is seen from the direction indicated by arrow F7, and FIG. 14(*e*) illustrates the fuel injection state when the virtual plane is seen from the direction indicated by arrow F8.

FIG. 15(*a*) is a cross sectional view illustrating the front end side of the fuel injection device, FIG. 15(*b*) is a cross sectional view illustrating the nozzle plate, and FIG. 15(*c*) is an enlarged cross sectional view illustrating a part of the nozzle plate.

DETAILED DESCRIPTION OF THE INVENTION

Embodiments of the invention will be described in detail below with reference to the drawings.

First Embodiment

Figure 1:
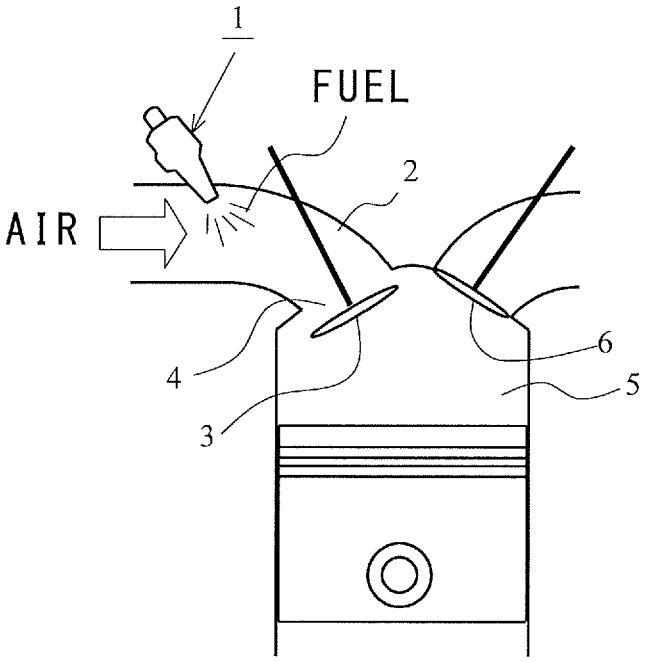
FIG. 1 schematically illustrates the use state of a fuel injection device to which a fuel injection device nozzle plate according to a first embodiment of the invention has been attached.

FIG. 1 schematically illustrates the use of a fuel injection device 1 to which a fuel injection device nozzle plate according to the first embodiment of the invention has been attached. As illustrated in FIG. 1, the fuel injection device 1 of port injection type is installed at a midpoint of the intake pipe 2 of a 4-valve engine. The fuel injection device 1 injects fuel into the intake pipe 2, mixes the air introduced to the intake pipe 2 with the fuel to form a combustible gas mixture, and supplies the combustible gas mixture from two intake ports 4 to a cylinder 5 when two intake valves 3 are opened. Note that FIG. 1 illustrates only one of the two intake valves 3 and 3 and only one of two exhaust valves 6 and 6.

Figure 2A:
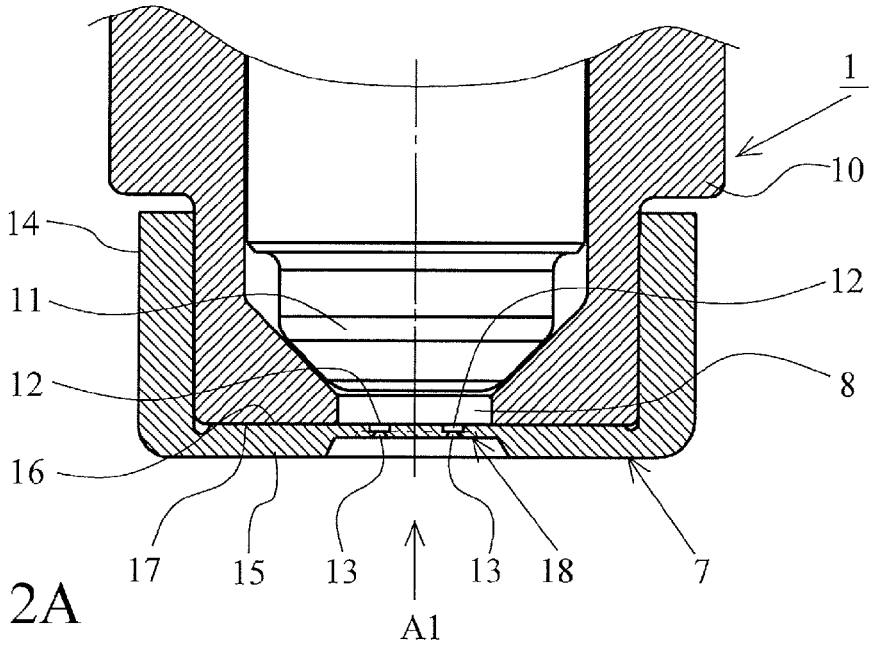
FIGS. 2*a*-2*b* illustrate the front end side of the fuel injection device to which the fuel injection device nozzle plate according to the first embodiment of the invention has been attached.
Figure 2B:
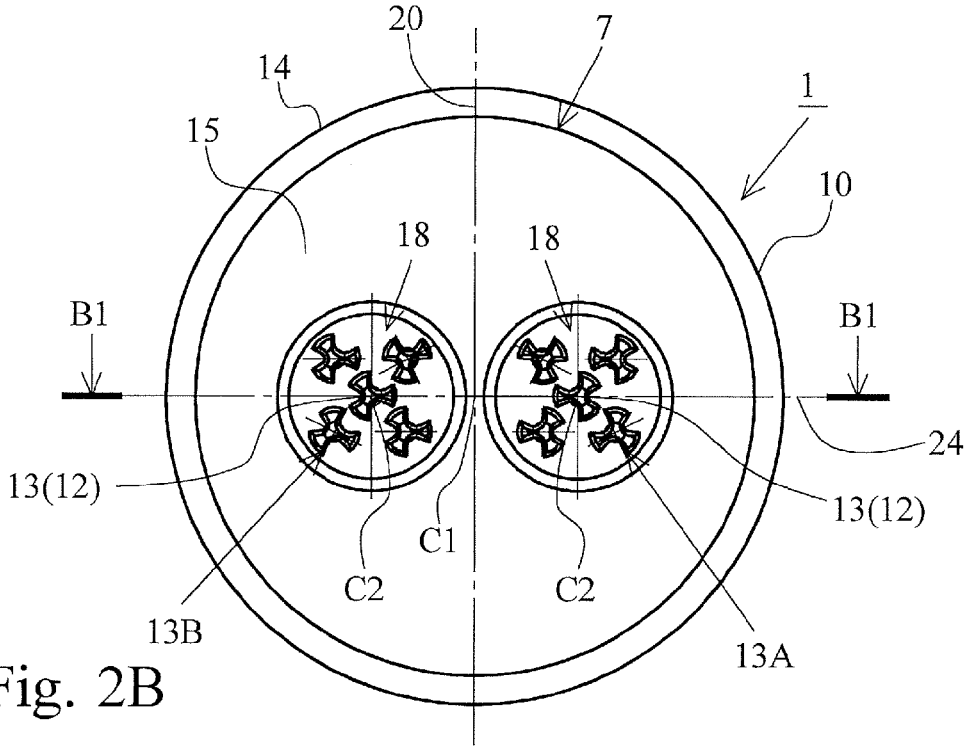
Figure 3C:
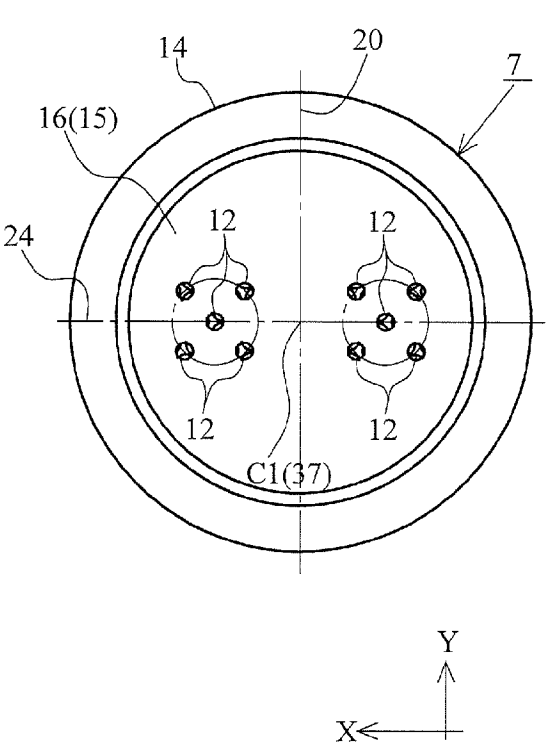
FIGS. 3*a*-3*c* illustrate the nozzle plate according to the first embodiment of the invention.
Figure 3B:
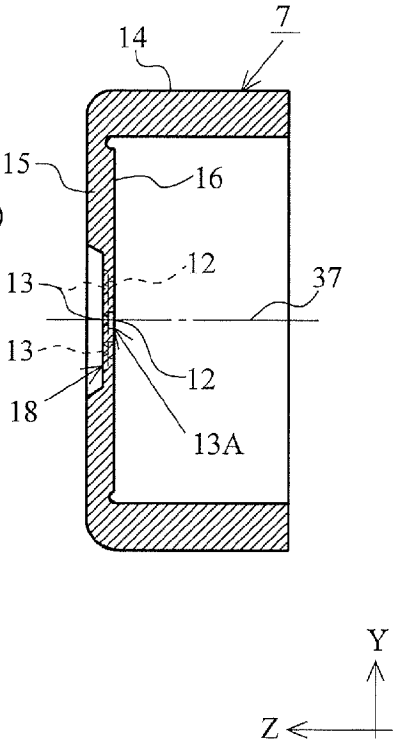
Figure 3A:
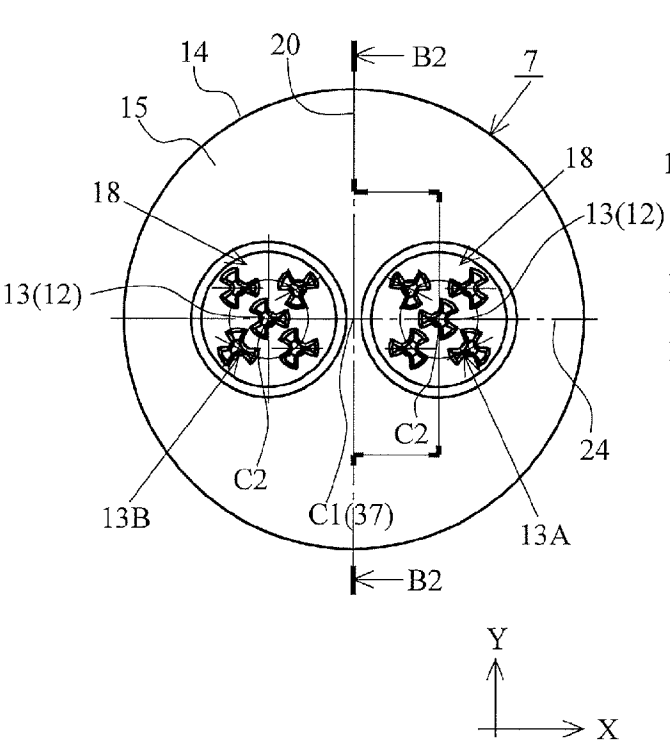
Figure 4A:
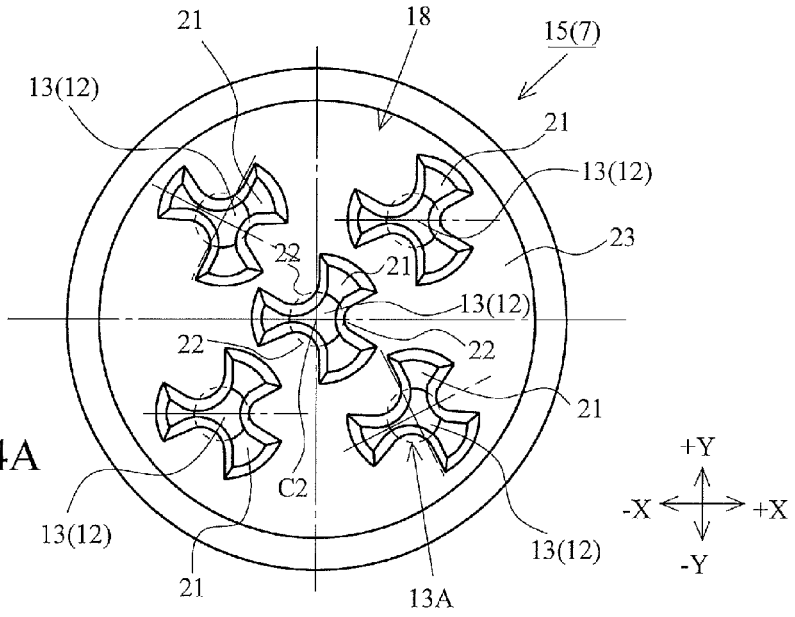
FIGS. 4*a*-4*c* are enlarged views illustrating a part of the nozzle plate according to the first embodiment of the invention.
Figure 4B:
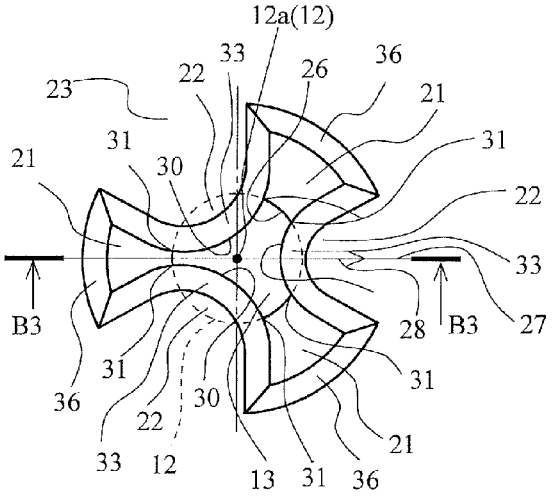
Figure 4C:
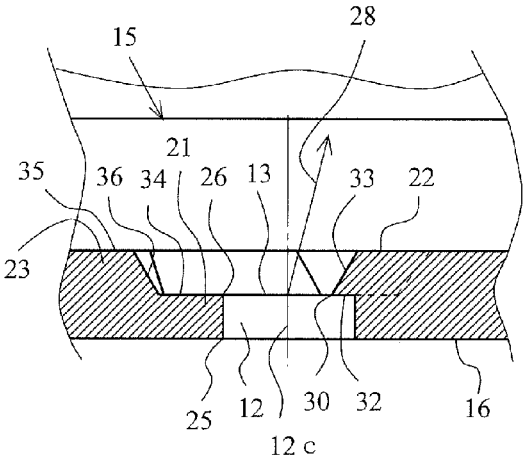
Figures 5A, 5B, 5C, 5D, 5E:
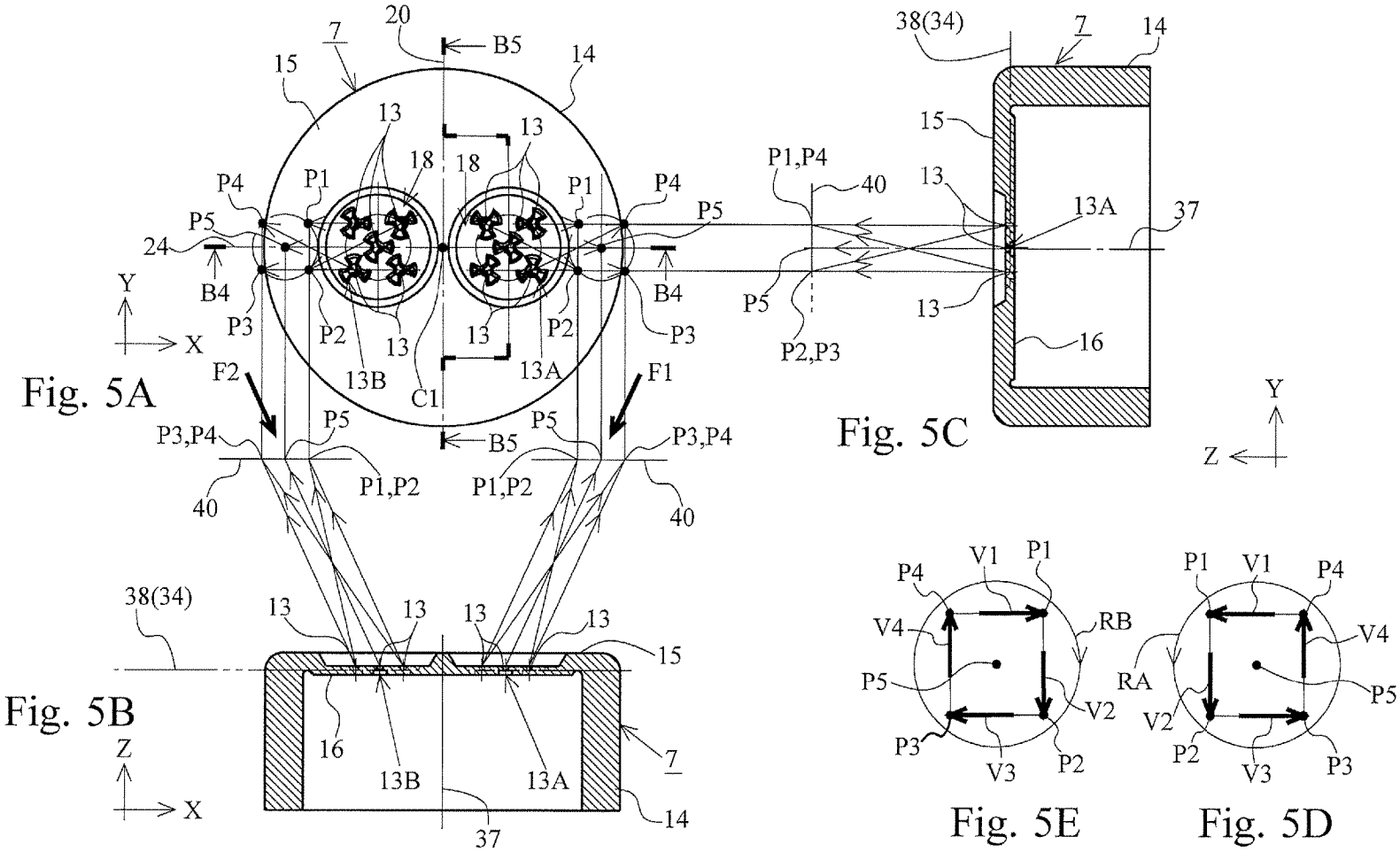
FIGS. 5*a*-5*d* illustrate the fuel injection state of the nozzle plate according to the first embodiment of the invention and schematically illustrates the fuel injection state of a first orifice group and the fuel injection state of a second orifice group.

The fuel injection device nozzle plate 7 (referred to below as the nozzle plate) according to the first embodiment of the invention will be described below with reference to FIGS. 2*a* to 5*e*. FIGS. 2*a* and 2*b* illustrate the front end side of the fuel injection device 1 to which the nozzle plate 7 according to the embodiment has been attached. FIGS. 3*a*-3*c* illustrate the nozzle plate 7 according to the embodiment. In addition, FIGS. 4*a*-4*c* are enlarged views illustrating a part of the nozzle plate 7 according to the embodiment. In addition, FIGS. 5*a*-5*e* illustrate the fuel injection state of the nozzle plate 7 according to the embodiment.

As illustrated in FIG. 2*a*, the fuel injection device 1 has the nozzle plate 7 on the front end side of a valve body 10 in which the fuel injection port 8 is formed. In the fuel injection device 1, a needle valve 11 is opened or closed by a solenoid (not illustrated). When the needle valve 11 is opened, fuel in the valve body 10 is injected from the fuel injection port 8, and the fuel injected from the fuel injection port 8 is injected externally through the nozzle hole 12 and the orifice 13 of the nozzle plate 7.

As illustrated in FIG. 2*a* to FIG. 4*c*, the nozzle plate 7 is a bottomed cylindrical body, made of synthetic resin (for example, PPS, PEEK, POM, PA, PES, PEI, or LCP), that includes a cylindrical wall part 14 and a bottom wall part 15 formed integrally with one end side of the cylindrical wall part 14. This nozzle plate 7 is fixed to the valve body 10 in a state in which the cylindrical wall part 14 is fitted onto the outer periphery of the front end side of the valve body 10 without any space, and an inner plane 16 of the bottom wall part 15 abuts against a front end surface 17 of the valve body 10. The bottom wall part 15 is provided with the pair of nozzle hole formation concave portions 18 by, for example, countersinking the bottom wall part 15 in a truncated cone shape. The pair of nozzle hole formation concave portions 18 is circular in plan view and formed line-symmetrically with respect to a center line 20 (center line 20 passing through a center C1 of the nozzle plate 7 along the Y-axis direction of the X-Y orthogonal coordinate system) of the bottom wall part 15. The nozzle hole formation concave portion 18 is provided with nozzle hole plate parts 21 in which the nozzle holes 12 are opened, and an interference body plate part 23 in which the interference bodies 22 are formed. The pair of nozzle hole formation concave portions 18 is formed so that centers C2 are positioned in a center line 24 (center line 24 passing through the center C1 of the nozzle plate 7 along the X-axis direction of the X-Y orthogonal coordinate system) of the bottom wall part 15. The interference body plate part 23 corresponds to the bottom part of the nozzle hole formation concave portions 18. In addition, the nozzle hole plate part 21 is shaped by, for example, partially countersinking the part around the nozzle hole 12 of the interference body plate part 23 and has a thickness smaller than that of the interference body plate part 23.

The one nozzle hole 12 is formed at the center C2 of the nozzle hole formation concave portion 18 and the four nozzle holes 12 are formed at regular intervals around the center C2 of the nozzle hole formation concave portion 18 so that parts of these nozzle holes 12 pass through (parts of these nozzle holes 12 are opened in the front and rear) the front and rear of the nozzle hole plate part 21 and the fuel injection port 8 of the valve body 10 communicates with the outside. These nozzle holes 12 are straight circular holes orthogonal to the inner plane 16 of the bottom wall part 15, introduce the fuel injected through the fuel injection port 8 of the valve body 10 from an inlet side opening 25 facing the fuel injection port 8, and inject the fuel introduced from the inlet side opening 25 from the part (the part of the opening from which the fuel flows out) of the outlet side opening 26 facing the outside. The shapes of the outlet side openings 26 of the nozzle holes 12 are circular.

In addition, as illustrated in FIGS. 4*a*-4*c*, in the interference body plate part 23 of the nozzle hole formation concave portion 18, the three interference bodies 22 are formed for each nozzle hole 12 to block a part of the nozzle hole 12. These three interference bodies 22 form the orifice 13 having a shape line-symmetric with respect to a center line 27 passing through a nozzle hole center 12*a*, a central direction 28 of the spray injected from the orifice 13 is inclined (inclined in the +X direction in FIG. 4(*c*)) obliquely with respect to a central axis 12*c* of the nozzle hole 12, and the central direction 28 of the spray injected from the orifice 13 is along the straight line 27 (see FIG. 4(*b*)). The orifice 13 described above is formed for each nozzle hole 12 and the five orifices 13 are formed for each of the nozzle hole formation concave portions 18 (see FIG. 2(*b*) and FIG. 3(*a*)). In FIG. 3(*a*), the nozzle hole formation concave portion 18 positioned to the right of the center C1 of the nozzle plate 7 is assumed to be the first nozzle hole formation concave portion 18 and a group including the five orifices 13 in the first nozzle hole formation concave portion 18 is assumed to be a first orifice group 13A. In addition, in FIG. 3(*a*), the nozzle hole formation concave portion 18 positioned to the left of the center C1 of the nozzle plate 7 is assumed to be the second nozzle hole formation concave portion 18 and a group including the five orifices 13 in the second nozzle hole formation concave portion 18 is assumed to be a second orifice group 13B. The first nozzle hole formation concave portion 18 and the first orifice group 13A and the second nozzle hole formation concave portions 18 and the second orifice group 13B are line-symmetric with respect to the center line 20 (center line 20 parallel to the Y-axis) passing through the center C1 of the nozzle plate 7, as illustrated in FIG. 3(*a*). In addition, in each of the orifices 13, the central direction 28 of the spray depends on how the three interference bodies 22 block the nozzle hole 12.

In addition, as illustrated in detail in FIGS. 4(*b*) and 4(*c*), the three interference bodies 22 formed in the interference body plate part 23 have a shape formed by partially cutting out a truncated cone, and the interference bodies 22 form the orifice 13 by partially blocking the nozzle hole 12. A corner portion 31 formed at the crossing part between an arc-shaped outer edge part 30 of the interference body 22 and the circular outlet side opening 26 of the nozzle hole 12 has an acute shape without roundness that can make the end part of the liquid film of fuel passing through the orifice 13 acute and sharp so that the fuel is easily atomized by friction with air. Although the corner portion 31 is formed at the crossing part between the arc-shaped outer edge part 30 of the interference body 22 and the circular outlet side opening 26 of the nozzle hole 12 in the nozzle plate 7 according to the embodiment, the invention is not limited to the embodiment and the corner portion 31 may be formed in an acute shape without roundness by a linear outer edge part of the interference body 22 and the arc-shaped outlet side opening 26 of the nozzle hole 12.

In addition, as illustrated in FIGS. 4*b* and 4*c*, the interference bodies 22 partially block the outlet side opening 26 of the nozzle hole 12, have a fuel collision surface 32 positioned orthogonally to the central axis 12*c* of the nozzle hole 12, and have a side surface (inclined plane) 33 crossing the fuel collision surface 32 at an acute angle. The fuel collision surface 32 of the interference body 22 and an outer plane 34 (the surface opposite to the inner plane 16) of the nozzle hole plate part 21 are present on a single plane. The side surface 33 of the interference body 22 is connected to a side surface (inclined plane) 36 connecting the outer plane 34 of the nozzle hole plate part 21 to an outer plane 35 of the interference body plate part 23. The side surface 36 connecting the outer plane 34 of the nozzle hole plate part 21 to the outer plane 35 of the interference body plate part 23 is formed away from the outlet side opening 26 of the nozzle hole 12 so as to be positioned substantially equidistantly from the outlet side opening 26 of the nozzle hole 12 opened to the nozzle hole plate part 21 not to prevent the spray injected from the nozzle hole 12. In the embodiment, the side surface 36 connecting the outer plane 34 of the nozzle hole plate part 21 to the outer plane 35 of the interference body plate part 23 and the side surface 33 of the interference body 22 are formed at a single inclined angle so as to facilitate the machining of an injection molding die.

FIGS. 5*a*-5*e* illustrate the fuel injection state of the nozzle plate 7 according to the embodiment and schematically illustrate the fuel injection state of the first orifice group 13A and the fuel injection state of the second orifice group 13B. The fuel injection state of the first orifice group 13A and the fuel injection state of the second orifice group 13B are line-symmetric with respect to the center line 20 (center line 20 parallel to the Y-axis) passing through the center C1 of the nozzle plate 7 in FIG. 5(*a*). In addition, the fuel injection state of the first orifice group 13A and the fuel injection state of the second orifice group 13B are line-symmetric with respect to a central axis 37 (central axis 37 parallel to the Z-axis) of the nozzle plate 7 in FIG. 5(*b*). Accordingly, to omit duplicate descriptions, the first orifice group 13A and the fuel injection state of the first orifice group 13A will be mainly described and the second orifice group 13B and the fuel injection state of the second orifice group 13B will be additionally described as appropriate.

In FIGS. 5*a*-5*e*, since the outlet side openings 26 of the nozzle holes 12 are formed in the outer plane 34 of the nozzle hole plate part 21, the outer plane 34 of the nozzle hole plate part 21 is assumed to be a virtual reference plane 38 parallel to the X-axis and a virtual plane positioned at a predetermined distance in the Z-axis direction from the virtual reference plane 38 is assumed to be a virtual spray reach plane 40. In addition, when the center C2 of the first nozzle hole formation concave portions 18 is the center of the X-Y orthogonal coordinate system in FIG. 5(*a*), the orifice 13 positioned in the first quadrant is assumed to be the first orifice 13, the orifices 13 positioned in the second quadrant, the third quadrant, and the fourth quadrant are assumed to be the second orifice 13, the third orifice 13, and the fourth orifice 13, and the orifice 13 positioned at the center of the X-Y orthogonal coordinate system is assumed to be the central orifice 13.

The first orifice 13 is formed so that fuel fine particles positioned at the center of a spray reach the point P1 on the virtual spray reach plane 40. In addition, the second orifice 13 is formed so that fuel fine particles positioned at the center of a spray reach the point P2 on the virtual spray reach plane 40. In addition, the third orifice 13 is formed so that fuel fine particles positioned at the center of a spray reach the point P3 on the virtual spray reach plane 40. In addition, the fourth orifice 13 is formed so that fuel fine particles positioned at the center of a spray reach the point P4 on the virtual spray reach plane 40. In addition, the central orifice 13 is formed so that fuel fine particles positioned at the center of a spray reach the point P5 on the virtual spray reach plane 40. The straight lines connecting the point P1, the point P2, the point P3, the point P4, and the point P1 in this order on the virtual spray reach plane 40 form a rectangle around the point P5 (see FIG. 5(*d*)).

In addition, as illustrated in FIG. 5(*d*), when the virtual spray reach plane 40 is seen from the direction indicated by arrow F1, which is opposite to fuel injection direction (the spray center direction toward the intake port 4 of the cylinder 5) from the central orifice 13, the velocity component of fuel fine particles at the center of a spray from the first orifice 13 is a first velocity component V1 from the point P4 to the point P1, the velocity component of fuel fine particles at the center of a spray from the second orifice 13 is a second velocity component V2 from the point P1 to the point P2, the velocity component of fuel fine particles at the center of a spray from the third orifice 13 is a third velocity component V3 from the point P2 to the point P3, and the velocity component of fuel fine particles at the center of a spray from the fourth orifice 13 is a fourth velocity component V4 from the point P3 to the point P4. These first to fourth velocity components V1 to V4 are velocity components in the counterclockwise direction around the point P5. The atomized droplets (fuel fine particles) in the sprays injected from the first to fourth orifices have kinetic momentum including the counterclockwise velocity component and the velocity component along the fuel injection direction of the central orifice 13, draw ambient air, and provide the drawn air with the kinetic momentum. In addition, since the atomized droplets (fuel fine particles) in a spray injected from the central orifice 13 draw ambient air, the atomized droplets provide the drawn air with the kinetic momentum and draw the sprays from the first to fourth orifices 13. The air having obtained the kinetic momentum from the droplets (fuel fine particles) in the sprays from the orifices 13 interacts with adjacent sprays, changes to a counterclockwise (RA direction) spiral flow around the fuel injection direction of the central orifice 13, and conveys the droplets (fuel fine particles) toward the intake port 4 of the cylinder 5. Then, the droplets (fuel fine particles) in the sprays are conveyed by the helical air flow and prevented from scattering peripherally. Accordingly, the nozzle plate 7 according to the embodiment can reduce the amount of fuel adhering to the wall surface of the intake pipe 2, thereby improving the utilization efficiency of fuel.

As described above, the first orifice group 13A spirally drives the sprays counterclockwise (RA direction) (see FIG. 5(*d*)). In contrast, the second orifice group 13B spirally drives the sprays clockwise (RB direction) (see FIG. 5(*e*)). As a result, the rotation of the sprays from the first orifice group 13A and the rotation of the sprays from the second orifice group 13B do not weaken each other.

Figure 6A:
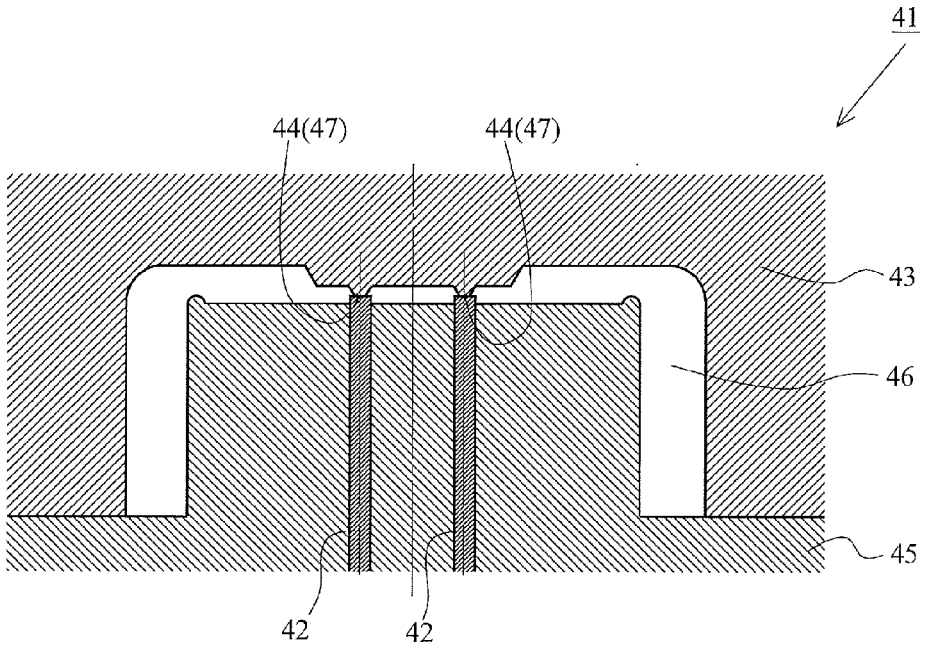
FIGS. 6*a*-6*b* are structural diagrams illustrating an injection molding die used for injection molding of the nozzle plate according to the first embodiment of the invention.
Figure 6B:
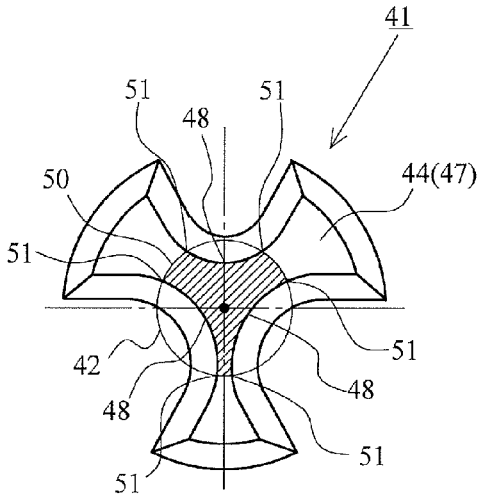

FIGS. 6*a* and 6*b* are a structural diagrams illustrating the injection molding die 41 used for injection molding of the nozzle plate 7. FIG. 6(*a*) is a vertical cross sectional view illustrating the injection molding die 41. In addition, FIG. 6(*b*) illustrates, in plan view, a cavity inner plane 44 of the first die 43 against which a nozzle hole formation pin 42 abuts.

As illustrated in FIG. 6*a*, in the injection molding die 41, the cavity 46 is formed between the first die 43 and the second die 45, and the nozzle hole formation pins 42 for forming the nozzle holes 12 project into the cavity 46 (see particularly FIG. 6(*a*)). The ends of the nozzle hole formation pins 42 abut against the cavity inner plane 44 of the first die 43 (see the shaded portion in FIG. 6(*b*)). The portions of the first die 43 against which the nozzle hole formation pins 42 abut are convex portions 47 for shaping the nozzle hole plate parts 21 and the orifices 13. The contour of convex portions 47 of the cavity inner plane 44 is easily machined by a machining tool having a blade with the same inclined angle as in the side surface 33 of the interference body 22. The crossing parts between the front end side outer edges 48 of the convex portions 47 of the cavity inner plane 44 and the front end side outer edges 50 of the nozzle hole formation pins 42 are acute and sharp corner portions 51 without roundness. The corner portions 51 shaped at the crossing parts between the front end side outer edges 48 of the convex portions 47 of the cavity inner plane 44 and the front end side outer edges 50 of the nozzle hole formation pins 42 form the corner portions 31 at crossing parts between the arc-shaped outer edge parts 30 of the interference bodies 22 and the circular outlet side opening 26 of the nozzle hole 12.

In the injection molding die 41 as described above, when molten resin (molten material) is injected from a gate (not illustrated) into the cavity 46 and the molten resin in the cavity 46 is cooled and solidified, the nozzle plate 7 illustrated in FIG. 3*a* to FIG. 5*e* is formed. In addition, in the nozzle plate 7 injection-molded using the injection molding die 41 as described above, the fuel collision surface 32 of the interference body 22 and the outer plane 34 of the nozzle hole plate part 21 are present on a single plane and the acute and sharp corner portion 31 without roundness is formed at the opening edge of the orifice 13. Since the nozzle plate 7 injection-molded as described above has production efficiency higher than that of a nozzle plate formed by the mechanical machining, discharge machining, or the like of metal, the product unit cost can be reduced.

In the nozzle plate 7 configured as described above, the sprays from the first orifice group 13A move to one of the intake ports 4 of the cylinder 5 while being spirally driven counterclockwise, and the sprays from the second orifice group 13B move to the other of the intake ports 4 while being spirally driven clockwise. Accordingly, in the nozzle plate 7 according to the embodiment, droplets (fuel fine particles) in the spray are conveyed by a helical air flow, prevented from scattering peripherally, and reduced in the amount adhering to the wall surface of the intake pipe 2 and the like. As a result, in the nozzle plate 7 according to the embodiment, the amount of atomized fuel supplied from the intake port 4 to the cylinder 5 can be increased and the utilization efficiency of fuel can be improved.

In addition, in the nozzle plate 7 according to the embodiment, the orifice 13 is formed by blocking the outlet side opening 26 of the nozzle hole 12 using the three interference bodies 22 and the fuel injection direction is determined by how the three interference bodies 22 block the outlet side opening 26 of the nozzle hole 12. Moreover, the entire nozzle plate 7 according to the embodiment is manufactured by injection molding. Accordingly, in the nozzle plate 7 according to the embodiment, the production cost can be reduced as compared with a conventional nozzle plate manufactured by, for example, cutting a metal member.

In addition, in the nozzle plate 7 according to the embodiment, a part of fuel injected from the fuel injection port 8 of the fuel injection device 1 collides with the fuel collision surface 32 of the interference body 22 and the fuel is atomized. At the same time, a flow of the fuel is sharply bent by the fuel collision surface 32, collides with fuel attempting to go straight through the nozzle hole 12 and the orifice 13, and disturbs a flow of the fuel attempting to go straight through the nozzle hole 12 and the orifice 13. In addition, in the nozzle plate 7 according to the embodiment, the opening edge of the orifice 13 has the acute and sharp corner portions 31 without roundness and the opening edge of the orifice 13 is narrowed toward the corner portions 31. As a result, in the nozzle plate 7 according to the embodiment, of the fuel injected from the orifice 13, the liquid film of the fuel injected from the corner portions 31 of the orifice 13 or its vicinity is made thin and acutely sharp, so the fuel injected from the corner portions 31 of the orifice 13 or its vicinity is easily atomized by friction with air in the vicinity of the orifice 13.

Moreover, in the nozzle plate 7 according to the embodiment, since the side surface 33 of the interference body 22 crosses the fuel collision surface 32 of the interference body 22 at an acute angle and an air layer is generated between the fuel having passed through the orifice 13 and the side surface 33 of the interference body 22, the fuel having passed through the orifice 13 easily draws air and the atomization of the fuel having passed through the orifice 13 is promoted.

Modification of the First Embodiment

Figure 7C:
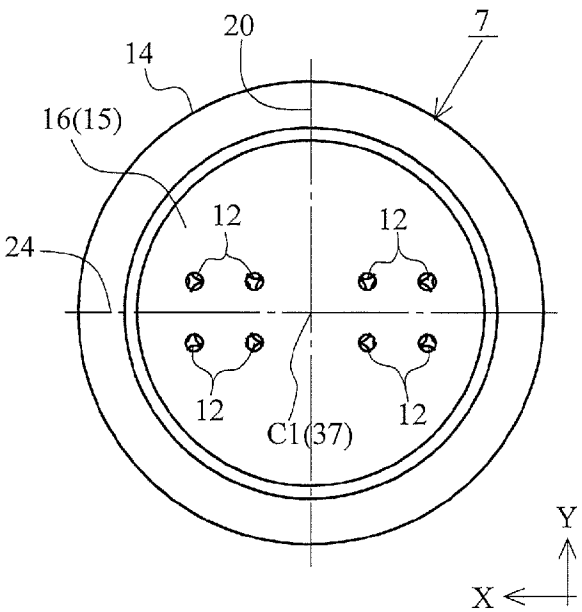
FIGS. 7*a*-7*c* illustrate a nozzle plate according to a modification of the first embodiment of the invention.
Figure 7B:
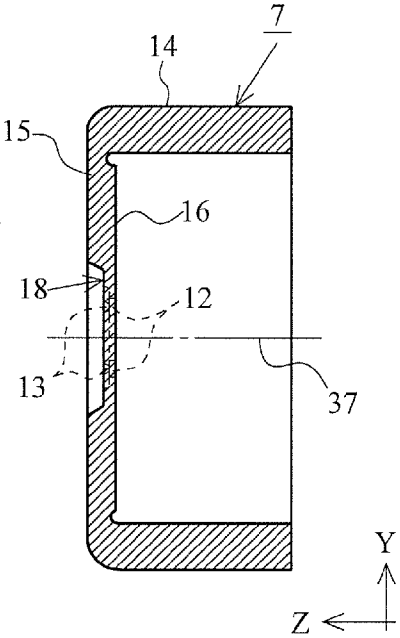
Figure 7A:
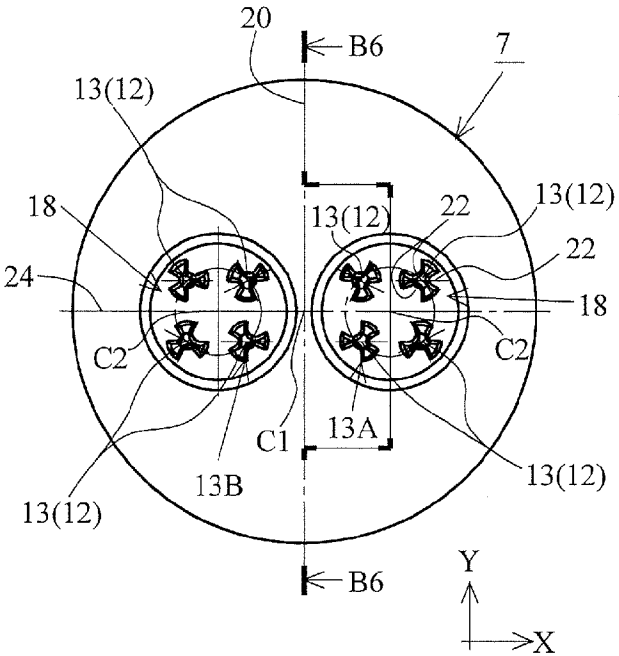
Figures 8A, 8B, 8C, 8D, 8E:
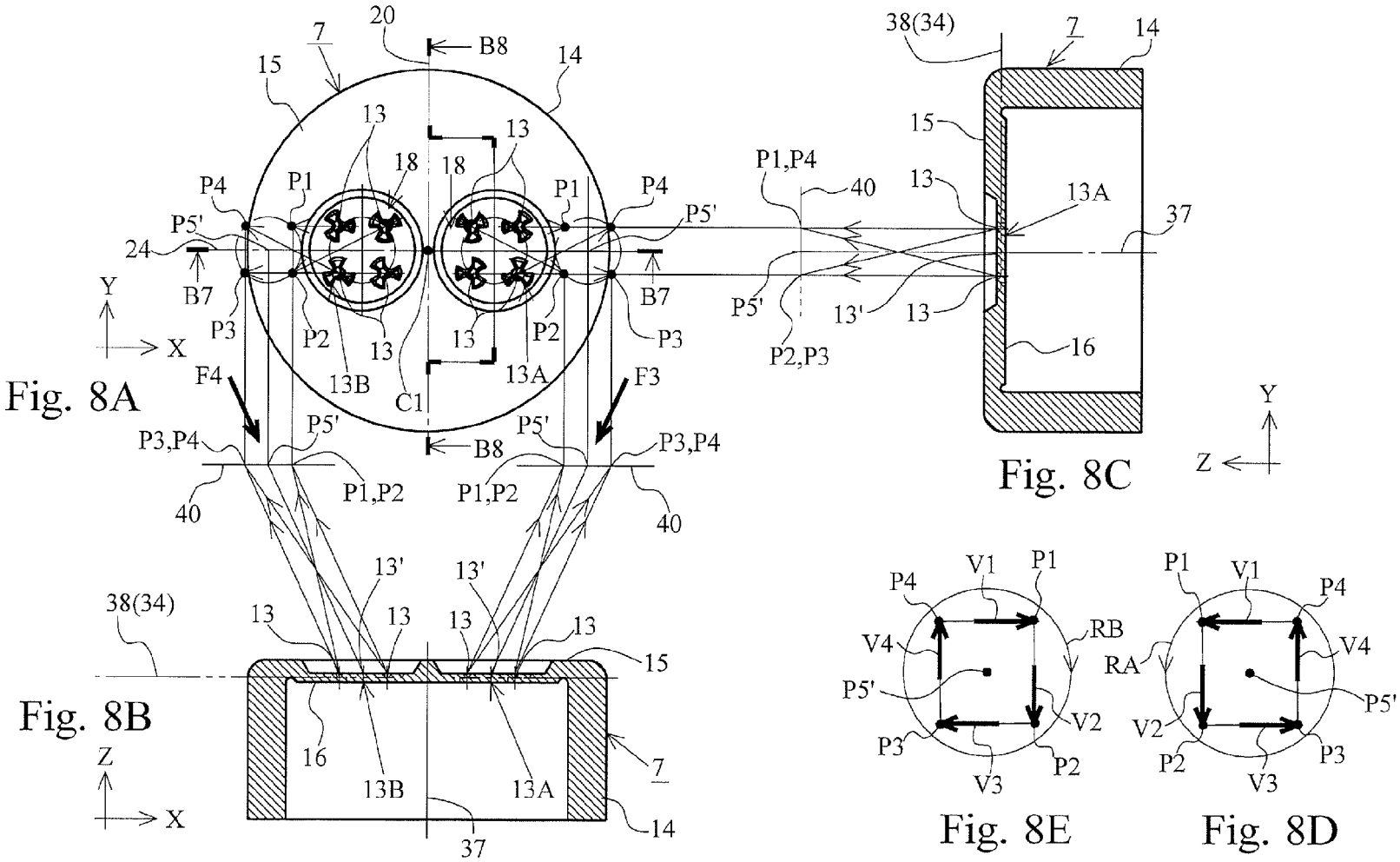
FIGS. 8*a*-8*d* illustrate the fuel injection state of the nozzle plate according to the modification of the first embodiment of the invention and schematically illustrates the fuel injection state of the first orifice group and the fuel injection state of the second orifice group.

The nozzle plate 7 according to the modification will be described below with reference to FIG. 7*a* to FIG. 8*e*. FIGS. 7*a*-7*c* illustrate the nozzle plate 7 according to the modification, and theses drawings correspond to FIGS. 3*a*-3*c*. In addition, FIGS. 8*a*-8*e* illustrate the fuel injection state of the nozzle plate 7 according to the modification, and these drawings correspond to FIGS. 5*a*-5*e*. In the following descriptions of the nozzle plate 7 according to the modification, duplicate descriptions as in the nozzle plate 7 according to the first embodiment will be omitted as appropriate.

In the nozzle plate 7 according to the modification, the central nozzle holes 12 and the central orifices 13 in the nozzle plate 7 according to the first embodiment are omitted. That is, in the nozzle plate 7 according to the modification, the four nozzle holes 12 are formed at regular intervals around the center C2 of the nozzle hole formation concave portion 18, and each of the nozzle holes 12 is partially blocked by the three interference bodies 22, and the orifice 13 is formed for each of the nozzle holes 12.

The first orifice 13 is formed so that the center of the spray reaches the point P1 on the virtual spray reach plane 40. In addition, the second orifice 13 is formed so that the center of the spray reaches the point P2 on the virtual spray reach plane 40. In addition, the third orifice 13 is formed so that the center of the spray reaches the point P3 on the virtual spray reach plane 40. In addition, the fourth orifice 13 is formed so that the center of the spray reaches the point P4 on the virtual spray reach plane 40. The straight lines connecting the point P1, the point P2, the point P3, the point P4, and the point P1 in this order on the virtual spray reach plane 40 form a rectangle. In this modification, the points P1 to P4 match the points P1 to P4 on the nozzle plate according to the first embodiment. In addition, in the nozzle plate 7 according to the modification, a virtual central orifice 13' corresponding to the central orifice 13 of the nozzle plate 7 according to the first embodiment is assumed and the virtual fuel injection direction of the virtual central orifice 13' is assumed to match the fuel injection direction (the central direction of the spray toward the intake port 4 of the cylinder 5) of the central orifice 13 in the nozzle plate 7 according to the first embodiment. The crossing point between the virtual fuel injection direction of the virtual central orifice 13' and the virtual spray reach plane 40 is assumed to be P5'.

In addition, as illustrated in FIG. 8(*d*), when the virtual spray reach plane 40 as seen from the direction indicated by arrow F3, which is opposite to the virtual fuel injection direction of the virtual central orifice 13', the velocity component of fuel fine particles at the center of the spray from the first orifice 13 is the first velocity component V1 from the point P4 to the point P1, the velocity component of fuel fine particles at the center of the spray from the second orifice 13 is the second velocity component V2 from the point P1 to the point P2, the velocity component of fuel fine particles at the center of the spray from the third orifice 13 is the third velocity component V3 from the point P2 to the point P3, and the velocity component of fuel fine particles at the center of the spray from the fourth orifice 13 is the fourth velocity component V4 from the point P3 to the point P4. These first to fourth velocity components V1 to V4 are velocity components in the counterclockwise direction around the point P5'. The atomized droplets (fuel fine particles) in the sprays injected from the first to fourth orifices 13 have kinetic momentum including the counterclockwise velocity component and the velocity component along the virtual fuel injection direction of the virtual central orifice 13', draw ambient air, and provide the drawn air with the kinetic momentum. The air having obtained the kinetic momentum from the droplets (fuel fine particles) in the sprays from the orifices 13 interacts with adjacent sprays, changes to a counterclockwise (RA direction) spiral flow around the virtual fuel injection direction of the virtual central orifice 13', and conveys the droplets (fuel fine particles) toward the intake port 4 of the cylinder 5. Then, the droplets (fuel fine particles) in the sprays are conveyed by the helical air flow and the droplets are prevented from scattering peripherally. Accordingly, the nozzle plate 7 according to the embodiment can reduce the amount of fuel adhering to the wall surface of the intake pipe 2 as in the nozzle plate 7 according to the first embodiment, thereby improving the utilization efficiency of fuel.

As described above, the first orifice group 13A spirally drives the sprays counterclockwise (RA direction) (see FIG. 8(*d*)). In contrast, the second orifice group 13B spirally drives the sprays clockwise (RB direction) (see FIG. 8(*e*)). As a result, the rotation of the sprays from the first orifice group 13A and the rotation of the sprays from the second orifice group 13B do not weaken each other.

Second Embodiment

Figures 9A, 9B, 9C:
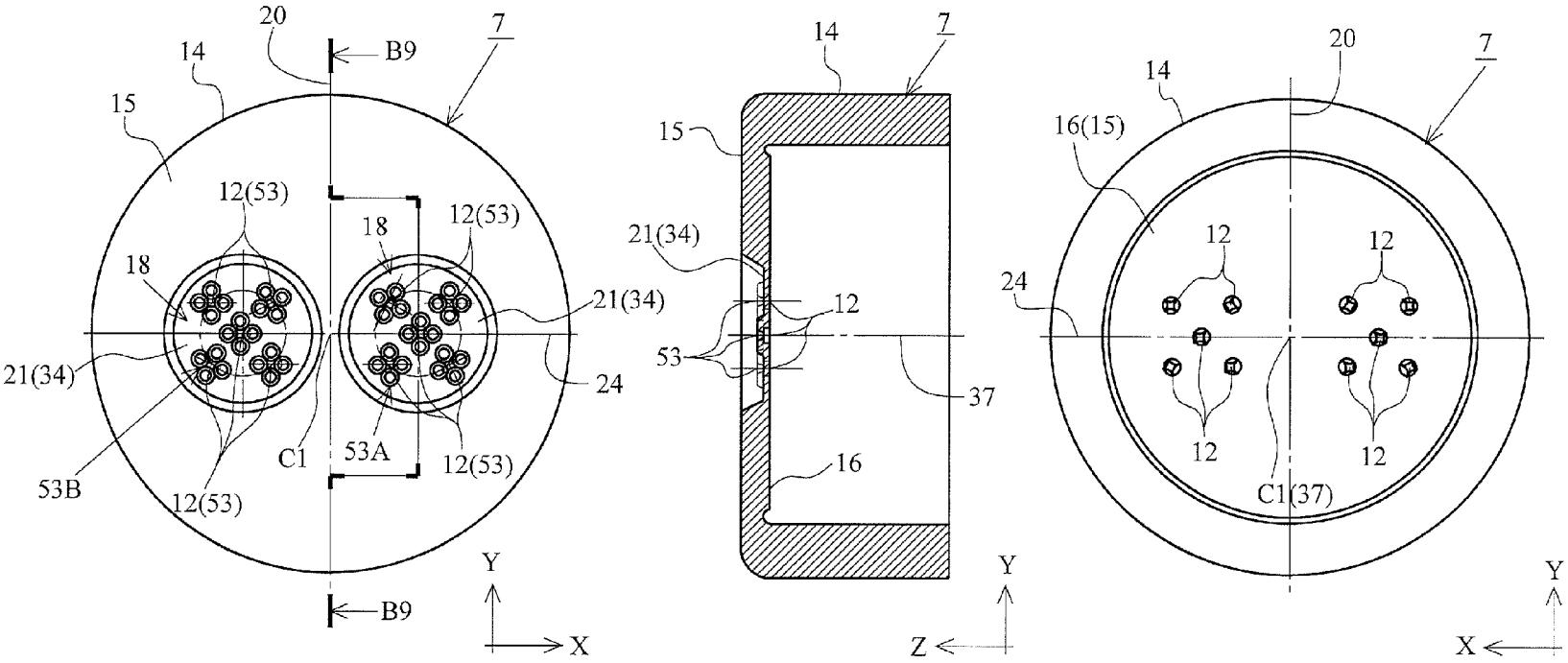
FIGS. 9*a*-9*c* illustrate a nozzle plate according to the second embodiment of the invention.

FIG. 9*a* to FIG. 11*e* illustrate the nozzle plate 7 according to a second embodiment of the invention. FIGS. 9*a*-9*c* illustrate the nozzle plate 7 according to the embodiment. In addition, FIGS. 10*a*-10*e* are enlarged views illustrating a part of the nozzle plate 7 according to the embodiment. In addition, FIGS. 11*a*-11*e* illustrate the fuel injection state of the nozzle plate 7 according to the embodiment.

As illustrated in FIG. 9*a* to FIG. 11*e*, the nozzle plate 7 is a bottomed cylindrical body, made of synthetic resin (for example, PPS, PEEK, POM, PA, PES, PEI, or LCP), that includes the cylindrical wall part 14 and the bottom wall part 15 formed integrally with one end side of the cylindrical wall part 14. This nozzle plate 7 is fixed to the valve body 10 in the state in which the cylindrical wall part 14 is fitted onto the outer periphery of the front end side of the valve body 10 without any space and the inner plane 16 of the bottom wall part 15 abuts against the front end surface 17 of the valve body 10 (see FIG. 2*a*). The bottom wall part 15 is provided with the pair of nozzle hole formation concave portions 18 and 18 by, for example, countersinking the bottom wall part 15 in a truncated cone shape. The pair of nozzle hole formation concave portions 18 is circular in plan view and formed line-symmetrically with respect to the center line 20 (center line 20 passing through a center C1 of the nozzle plate 7 along the Y-axis direction of the X-Y orthogonal coordinate system) of the bottom wall part 15. The nozzle hole formation concave portion 18 is provided with the nozzle hole plate part 21 at the bottom, the plurality of nozzle holes 12 are formed in the nozzle hole plate part 21, and the plurality of interference bodies 52 are formed in the part of the nozzle hole plate part 21 close to the outer plane 34 (the surface opposite to the inner plane 16) around the nozzle hole 12. In addition, the centers C2 of the pair of nozzle hole formation concave portions 18 and 18 are positioned in the center line 24 (center line 24 passing through the center C1 of the nozzle plate 7 along the X-axis direction of the X-Y orthogonal coordinate system) of the bottom wall part 15.

The one nozzle hole 12 is formed at the center C2 of the nozzle hole formation concave portion 18 and the four nozzle holes 12 are formed at regular intervals around the center C2 of the nozzle hole formation concave portion 18 so that parts of these nozzle holes 12 pass through (parts of these nozzle holes 12 are opened in the front and rear) the front and rear of the nozzle hole plate part 21 and the fuel injection port 8 of the valve body 10 communicates with the outside. These nozzle holes 12 are straight circular holes orthogonal to the inner plane 16 of the bottom wall part 15, introduce the fuel injected through the fuel injection port 8 of the valve body 10 from an inlet side opening 25 facing the fuel injection port 8, and inject the fuel introduced from the inlet side opening 25 from the part (the part of the opening from which the fuel flows out) of the outlet side opening 26 facing the outside. The shapes of the outlet side openings 26 of the nozzle holes 12 are circular.

Figure 10A:
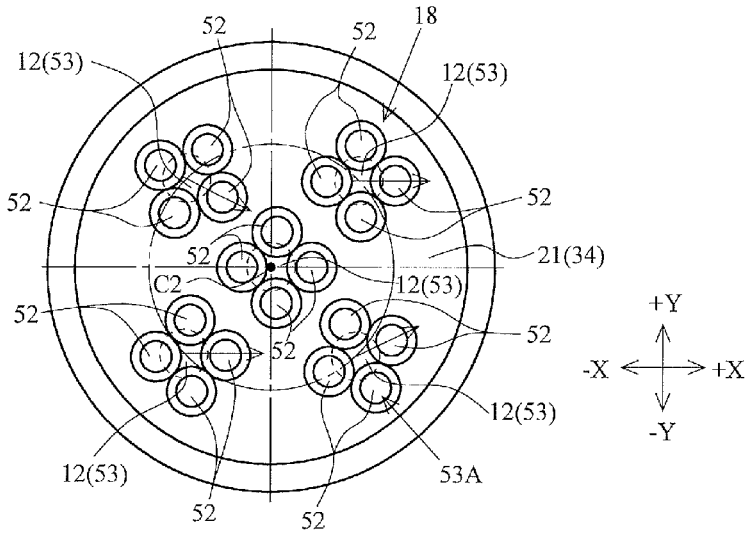
FIGS. 10*a*-10*e* are enlarged views illustrating a part of the nozzle plate according to the second embodiment of the invention.
Figure 10B:
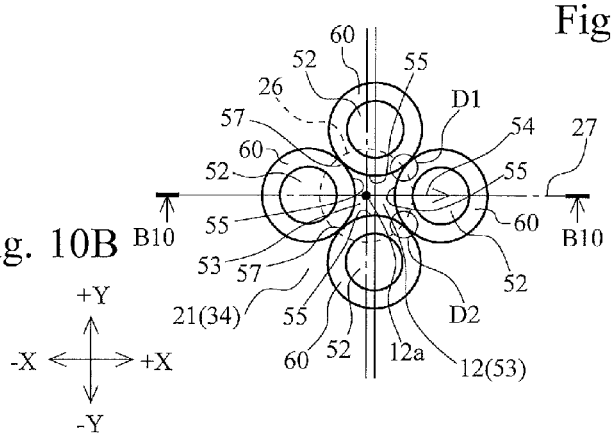
Figure 10C:
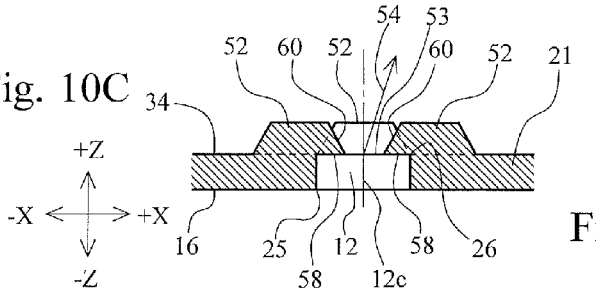
Figure 10D:
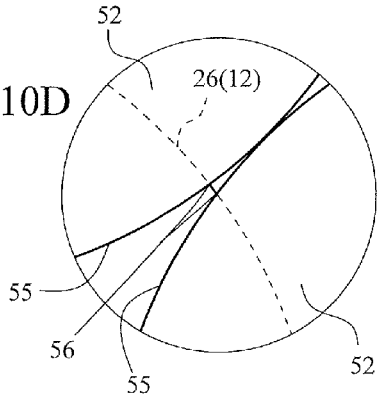
Figure 10E:
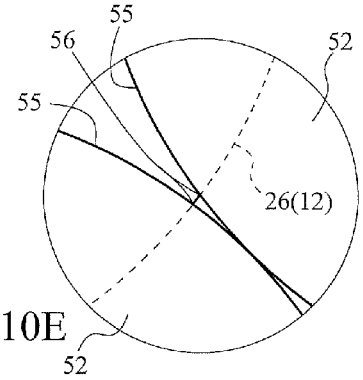
Figures 11A, 11B, 11C, 11D, 11E:
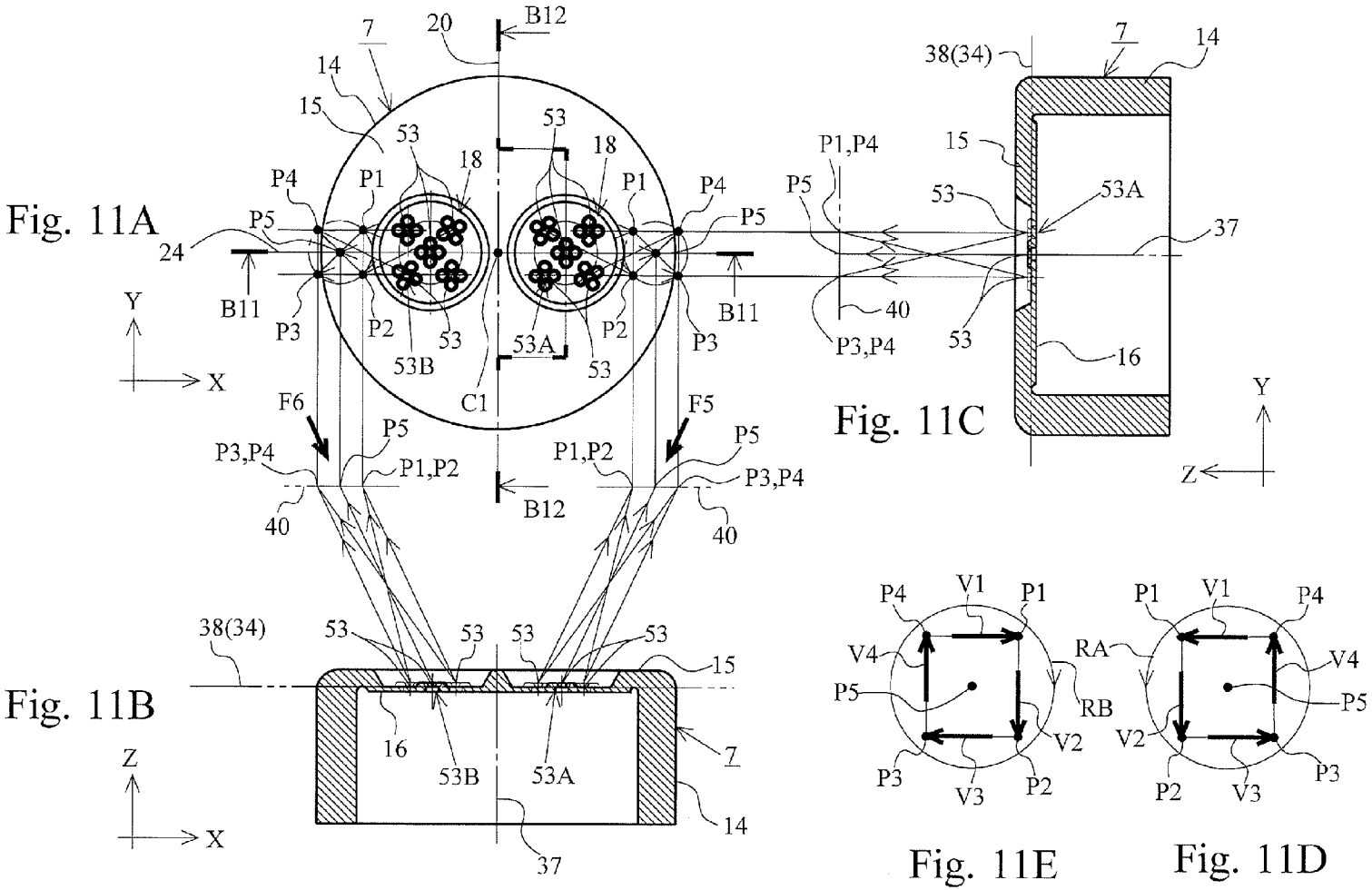
FIGS. 11*a*-11*e* illustrate the fuel injection state of the nozzle plate according to the second embodiment of the invention and schematically illustrates the fuel injection state of the first orifice group and the fuel injection state of the second orifice group.

In addition, as illustrated in FIGS. 10*a*-10*c*, in the nozzle hole plate part 21 of the nozzle hole formation concave portion 18, the four interference bodies 52 are formed for each nozzle hole 12 to block a part of the nozzle hole 12. These four interference bodies 52 form the orifice 53 having a shape line-symmetric with respect to a center line 27 passing through the nozzle hole center 12*a*, a central direction 54 of the spray injected from the orifice 53 is inclined obliquely with respect to the central axis 12*c* of the nozzle hole 12 (see FIG. 10(*c*)), and the central direction 54 of the spray injected from the orifice 53 is along the straight line 27 (see FIG. 10(*b*)). The orifice 53 described above is formed for each nozzle hole 12 and the five orifices 13 are formed for each of the nozzle hole formation concave portions 18 (see FIG. 9(*a*)). In FIG. 9(*a*), the nozzle hole formation concave portion 18 positioned to the right of the center C1 of the nozzle plate 7 is assumed to be the first nozzle hole formation concave portion 18 and a group including the five orifices 13 in the first nozzle hole formation concave portion 18 is assumed to be a first orifice group 53A. In addition, in FIG. 9(*a*), the nozzle hole formation concave portion 18 positioned to the left of the center C1 of the nozzle plate 7 is assumed to be the second nozzle hole formation concave portion 18 and a group including the five orifices 13 in the second nozzle hole formation concave portion 18 is assumed to be a second orifice group 53B. The first nozzle hole formation concave portion 18 and the first orifice group 53A and the second nozzle hole formation concave portions 18 and the second orifice group 53B are line-symmetric with respect to the center line 20 (center line 20 parallel to the Y-axis) passing through the center C1 of the nozzle plate 7, as illustrated in FIG. 9(*a*). In addition, in each of the orifices 53, the central direction 54 of the spray depends on how the four interference bodies 52 block the nozzle hole 12.

In addition, as illustrated in detail in FIGS. 10(*b*) and 10(*c*), the four interference bodies 52 formed in the nozzle hole plate part 21 have the same shape (truncated cone) and the same size. The four interference bodies 52 form the orifice 53 by partially blocking the nozzle hole 12. A corner portion 56 formed at the crossing part between an arc-shaped outer edge part 55 of the interference body 52 and the circular outlet side opening 26 of the nozzle hole 12 has an acute shape without roundness and can make the end part of a liquid film of fuel passing through the orifice 53 acute and sharp so that the fuel is easily atomized by friction with air. In addition, a corner portion 57 formed at the abutting part (crossing part) of the arc-shaped outer edge part 55 of the interference body 52 and the arc-shaped outer edge part 55 of the interference body 52 has an acute shape without roundness and can make the end part of a liquid film of fuel passing through the orifice 53 acute and sharp so that the fuel is easily atomized by friction with air. Although the corner portion 56 is formed at the crossing part between the arc-shaped outer edge part 55 of the interference body 52 and the circular outlet side opening 26 of the nozzle hole 12 in the nozzle plate 7 according to the embodiment, the invention is not limited to the embodiment and the corner portion 56 may be formed in an acute shape without roundness by a linear outer edge part of the interference body 52 and the arc-shaped outlet side opening 26 of the nozzle hole 12. Alternatively, the corner portion 57 may be formed in an acute shape without roundness by a linear outer edge part of the interference body 52 and a linear outer edge part of the interference body 52.

In addition, as illustrated in FIGS. 10*a*-10*c*, the interference bodies 52 partially block the outlet side opening 26 of the nozzle hole 12, have a fuel collision surface 58 positioned orthogonally to the central axis 12*c* of the nozzle hole 12, and have a side surface (inclined plane) 60 crossing the fuel collision surface 58 at an acute angle. The fuel collision surface 58 of the interference body 52 and the outer plane 34 (the surface opposite to the inner plane 16) of the nozzle hole plate part 21 are present on a single plane.

FIGS. 11*a*-11*e* illustrate the fuel injection state of the nozzle plate 7 according to the embodiment and schematically illustrates the fuel injection state of the first orifice group 53A and the fuel injection state of the second orifice group 53B. The fuel injection state of the first orifice group 53A and the fuel injection state of the second orifice group 53B are line-symmetric with respect to the center line 20 (center line 20 parallel to the Y-axis) passing through the center C1 of the nozzle plate 7 in FIG. 11(*a*). In addition, the fuel injection state of the first orifice group 53A and the fuel injection state of the second orifice group 53B are line-symmetric with respect to the central axis 37 (central axis 37 parallel to the Z-axis) of the nozzle plate 7 in FIG. 11(*b*). Accordingly, to omit duplicate descriptions, the first orifice group 53A and the fuel injection state of the first orifice group 53A will be mainly described and the second orifice group 53B and the fuel injection state of the second orifice group 53B will be additionally described as appropriate.

In the embodiment of FIGS. 11*a*-11*e*, since the outlet side opening edges of the orifices 53 are formed in the outer plane 34 of the nozzle hole plate part 21, the outer plane 34 of the nozzle hole plate part 21 is assumed to be a virtual reference plane 38 parallel to the X-axis and a virtual plane positioned at a predetermined distance in the Z-axis direction from the virtual reference plane 38 is assumed to be a virtual spray reach plane 40. In addition, when the center of the first nozzle hole formation concave portions 18 is the center of the X-Y orthogonal coordinate system in FIG. 11(*a*), the orifice 53 positioned in the first quadrant is assumed to be the first orifice 53, the orifices 53 positioned in the second quadrant, the third quadrant, and the fourth quadrant are assumed to be the second orifice 53, the third orifice 53, and the fourth orifice 53, and the orifice 53 positioned at the center of the X-Y orthogonal coordinate system is assumed to be the central orifice 53.

The first orifice 53 is formed so that the center of a spray reaches the point P1 on the virtual spray reach plane 40. In addition, the second orifice 53 is formed so that the center of a spray reaches the point P2 on the virtual spray reach plane 40. In addition, the third orifice 53 is formed so that the center of a spray reaches the point P3 on the virtual spray reach plane 40. In addition, the fourth orifice 53 is formed so that the center of a spray reaches the point P4 on the virtual spray reach plane 40. In addition, the central orifice 53 is formed so that the center of a spray reaches the point P5 on the virtual spray reach plane 40. The straight lines connecting the point P1, the point P2, the point P3, the point P4, and the point P1 in this order on the virtual spray reach plane 40 form a rectangle around the point P5 (see FIG. 11(*d*)).

In addition, as illustrated in FIG. 11(*d*), when the virtual spray reach plane 40 is seen from the direction indicated by arrow F5, which is opposite to fuel injection direction (the spray center direction toward the intake port 4 of the cylinder 5) from the central orifice 53, the velocity component at the center of a spray from the first orifice 53 is the first velocity component V1 from the point P4 to the point P1, the velocity component of the center of a spray from the second orifice 53 is the second velocity component V2 from the point P1 to the point P2, the velocity component at the center of a spray from the third orifice 53 is a third velocity component V3 from the point P2 to the point P3, and the velocity component at the center of a spray from the fourth orifice 53 is the fourth velocity component V4 from the point P3 to the point P4. These first to fourth velocity components V1 to V4 are velocity components in the counterclockwise direction around the point P5. The atomized droplets (fuel fine particles) in the sprays injected from the first to fourth orifices have kinetic momentum including the counterclockwise velocity component and the velocity component along the fuel injection direction of the central orifice 53, draw ambient air, and provide the drawn air with the kinetic momentum. In addition, since the atomized droplets (fuel fine particles) in a spray injected from the central orifice 53 draw ambient air, the atomized droplets provide the drawn air with the kinetic momentum and draw the sprays from the first to fourth orifices 53. The air having obtained the kinetic momentum from the droplets (fuel fine particles) in the sprays from the orifices 53 interacts with adjacent sprays, changes to a counterclockwise (RA direction) spiral flow around the fuel injection direction of the central orifice 53, and conveys the droplets (fuel fine particles) toward the intake port 4 of the cylinder 5. Then, the droplets (fuel fine particles) in the sprays are conveyed by the helical air flow and prevented from scattering peripherally. Accordingly, the nozzle plate 7 according to the embodiment can reduce the amount of fuel adhering to the wall surface of the intake pipe 2, thereby improving the utilization efficiency of fuel.

As described above, the first orifice group 53A spirally drives the sprays counterclockwise (RA direction) (see FIG. 11(*d*)). In contrast, the second orifice group 53B spirally drives the sprays clockwise (RB direction) (see FIG. 11(*e*)). As a result, the rotation of the sprays from the first orifice group 53A and the rotation of the sprays from the second orifice group 53B do not weaken each other.

Figure 12A:
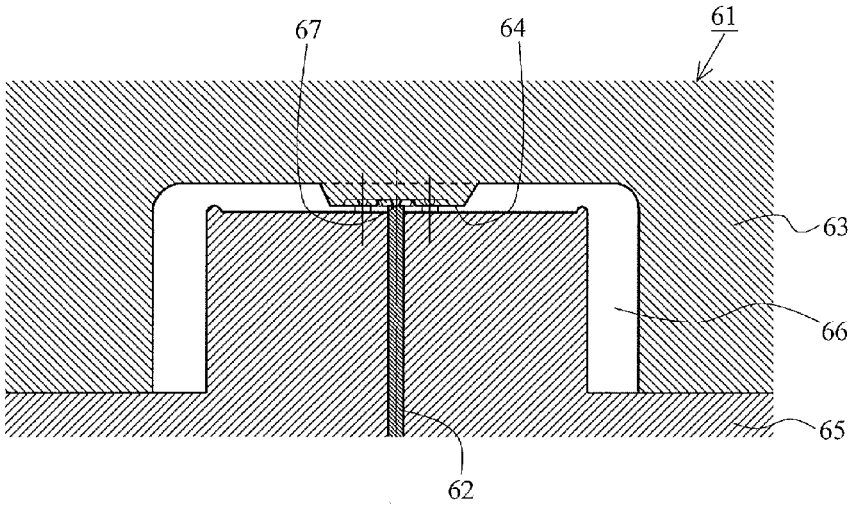
FIGS. 12*a*-12*c* are structural diagrams illustrating an injection molding die used for injection molding of the nozzle plate according to the second embodiment of the invention.
Figure 12B:
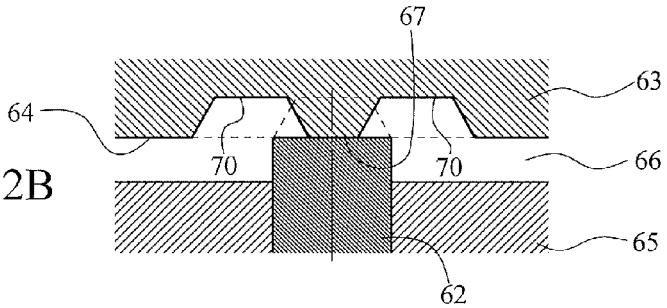
Figure 12C:
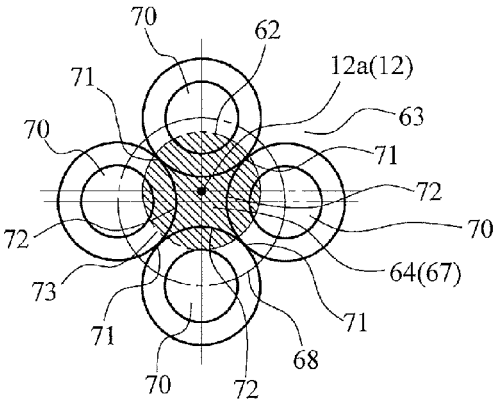

FIGS. 12*a*-12*c* are structural diagrams illustrating the injection molding die 61 used for injection molding of the nozzle plate 7. FIG. 12(*a*) is a vertical cross sectional view illustrating the injection molding die 61. In addition, FIG. 12(*b*) is a partial enlarged view of FIG. 12(*a*). FIG. 12(*c*) illustrates, in plan view, a cavity inner plane 64 of the first die 63 against which a nozzle hole formation pin 62 abuts.

As illustrated in FIGS. 12*a*-12*c*, in the injection molding die 61, the cavity 66 is formed between the first die 63 and the second die 65, and the nozzle hole formation pin 62 for forming the nozzle hole 12 projects into the cavity 66 (see particularly FIGS. 12(*a*) and 12(*b*)). The end of the nozzle hole formation pin 62 abuts against the cavity inner plane 64 of the first die 63 (see the shaded portions in FIG. 12(*b*) and FIG. 12(*c*)). The portion of the first die 63 against which the nozzle hole formation pin 62 abuts is a convex portion 67 for shaping parts of the interference body 52 and the orifice 53. The convex portion 67 of the cavity inner plane 64 is formed by forming the four truncated-cone-shaped concavities 70 at regular intervals along a circle 68 positioned eccentrically with the center 12*a* of the nozzle hole 12 and forming the truncated-cone-shaped concavities 70 adjacent to each other so that they make contact with each other. The corner portions 71 of the convex portion 67 formed in the portions at which the truncated-cone-shaped concavities 70 adjacent to each other make contact are formed in an acute and sharp shape. The corner portions 71 formed in the convex portion 67 of the cavity inner plane 64 shape at an abutting part (crossing part) of the arc-shaped outer edge part 55 of the interference body 52 and the arc-shaped outer edge part 55 of the interference body 52. The crossing parts between the front end side outer edge 72 of the convex portion 67 of the cavity inner plane 64 and the front end side outer edge 73 of the nozzle hole formation pin 62 are acute and sharp corner portions without roundness. The corner portions shaped at the crossing parts between the front end side outer edge 72 of the convex portion 67 of the cavity inner plane 64 and the front end side outer edge 73 of the nozzle hole formation pin 62 form the corner portions 56 at crossing parts between the arc-shaped outer edge part 55 of the interference body 52 and the circular outlet side opening 26 of the nozzle hole 12.

In the injection molding die 61 as described above, when molten resin (molten material) is injected from a gate (not illustrated) into the cavity 66 and the molten resin in the cavity 66 is cooled and solidified, the nozzle plate 7 illustrated in FIG. 9 to FIG. 11 is formed. In addition, in the nozzle plate 7 injection-molded using the injection molding die 61 as described above, the fuel collision surface 58 of the interference body 52 and the outer plane 34 of the nozzle hole plate part 21 are present on a single plane and the acute and sharp corner portion 56 without roundness is formed at the opening edge of the orifice 53 and the acute and sharp shape corner portion 57 without roundness is formed at the abutting part (crossing part) of the arc-shaped outer edge part 55 of the interference body 52 and the arc-shaped outer edge part 55 of the interference body 52. Since the nozzle plate 7 injection-molded as described above has production efficiency higher than that manufactured by mechanical machining, discharge machining, or the like, the product unit cost can be reduced.

In the nozzle plate 7 configured as described above, the sprays from the first orifice group 53A move to one of the intake ports 4 of the cylinder 5 while being spirally driven counterclockwise (RA direction) and the sprays from the second orifice group 53B move to the other of the intake ports 4 of the cylinder 5 while being spirally driven clockwise (RB direction). Accordingly, in the nozzle plate 7 according to the embodiment, droplets (fuel fine particles) in the sprays are conveyed by a helical air flow, prevented from scattering peripherally, and reduced in the amount adhering to the wall surface of the intake pipe 2 and the like. As a result, in the nozzle plate 7 according to the embodiment, the amount of atomized fuel supplied from the intake port 4 to the cylinder 5 can be increased and the utilization efficiency of fuel can be improved.

In addition, in the nozzle plate 7 according to the embodiment, the orifice 53 is formed by blocking the outlet side opening 26 of the nozzle hole 12 using the four interference bodies 52 and the fuel injection direction is determined by how the four interference bodies 52 block the outlet side opening 26 of the nozzle hole 12. Moreover, the entire nozzle plate 7 according to the embodiment is manufactured by injection molding. Accordingly, in the nozzle plate 7 according to the embodiment, the production cost can be reduced as compared with a conventional nozzle plate manufactured by, for example, cutting a metal member.

In addition, in the nozzle plate 7 according to the embodiment, a part of fuel injected from the fuel injection port 8 of the fuel injection device 1 collides with the fuel collision surface 58 of the interference body 52 and the fuel is atomized. At the same time, a flow of the fuel is sharply bent by the fuel collision surface 58, collides with fuel attempting to go straight through the nozzle hole 12 and the orifice 53, and disturbs a flow of the fuel attempting to go straight through the nozzle hole 12 and the orifice 53. In addition, in the nozzle plate 7 according to the embodiment, the opening edge of the orifice 53 has the acute and sharp corner portions 56 and 57 without roundness and the opening edge of the orifice 53 is narrowed toward the corner portions 56 and 57. As a result, in the nozzle plate 7 according to the embodiment, of the fuel injected from the orifice 53, the liquid film of the fuel injected from the corner portions 56 and 57 of the orifice 53 or their vicinity is made thin and acutely sharp, so the fuel injected from the corner portions 56 and 57 of the orifice 53 or their vicinity is easily atomized by friction with air in the vicinity of the orifice 53.

Moreover, in the nozzle plate 7 according to the embodiment, since the side surface 60 of the interference body 52 crosses the fuel collision surface 58 of the interference body 52 at an acute angle and an air layer is generated between the fuel having passed through the orifice 53 and the side surface 60 of the interference body 52, the fuel having passed through the orifice 13 easily draws air and the atomization of the fuel having passed through the orifice 53 is promoted.

Modification of the Second Embodiment

Figure 13C:
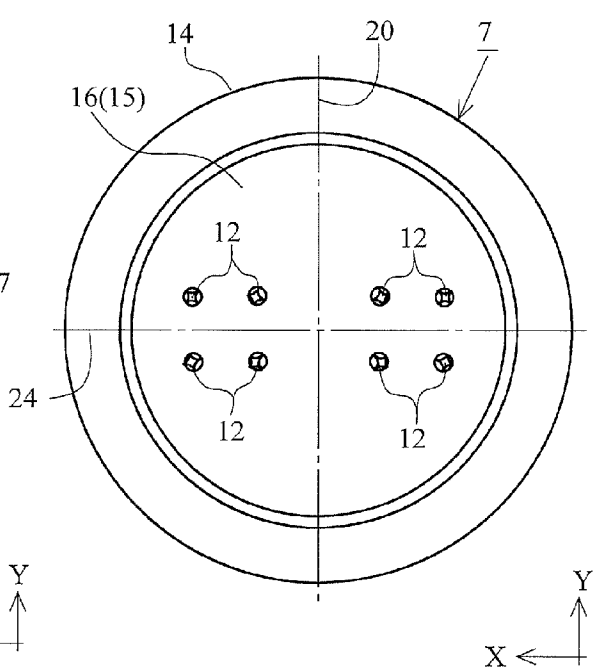
FIGS. 13*a*-13*c* illustrate a nozzle plate according to a modification of the second embodiment of the invention.
Figure 13B:
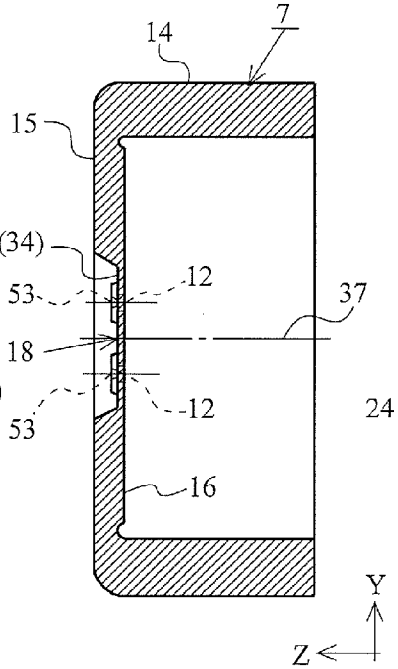
Figure 13A:
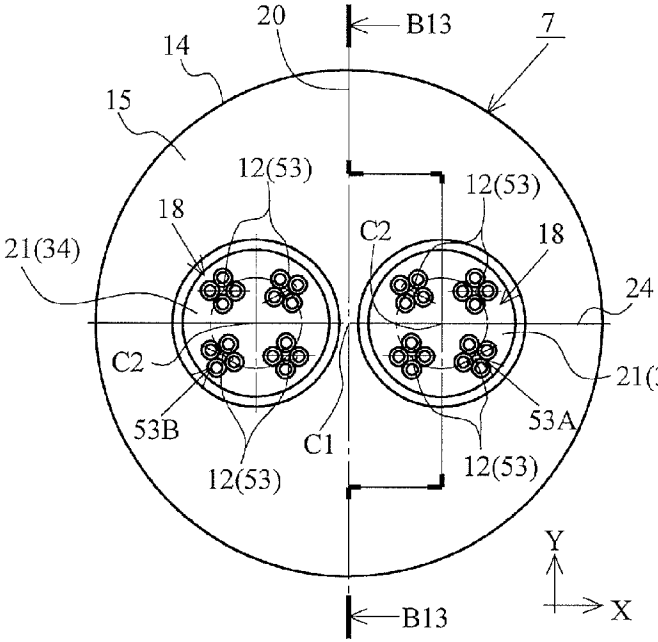
Figures 14A, 14B, 14C, 14D, 14E:
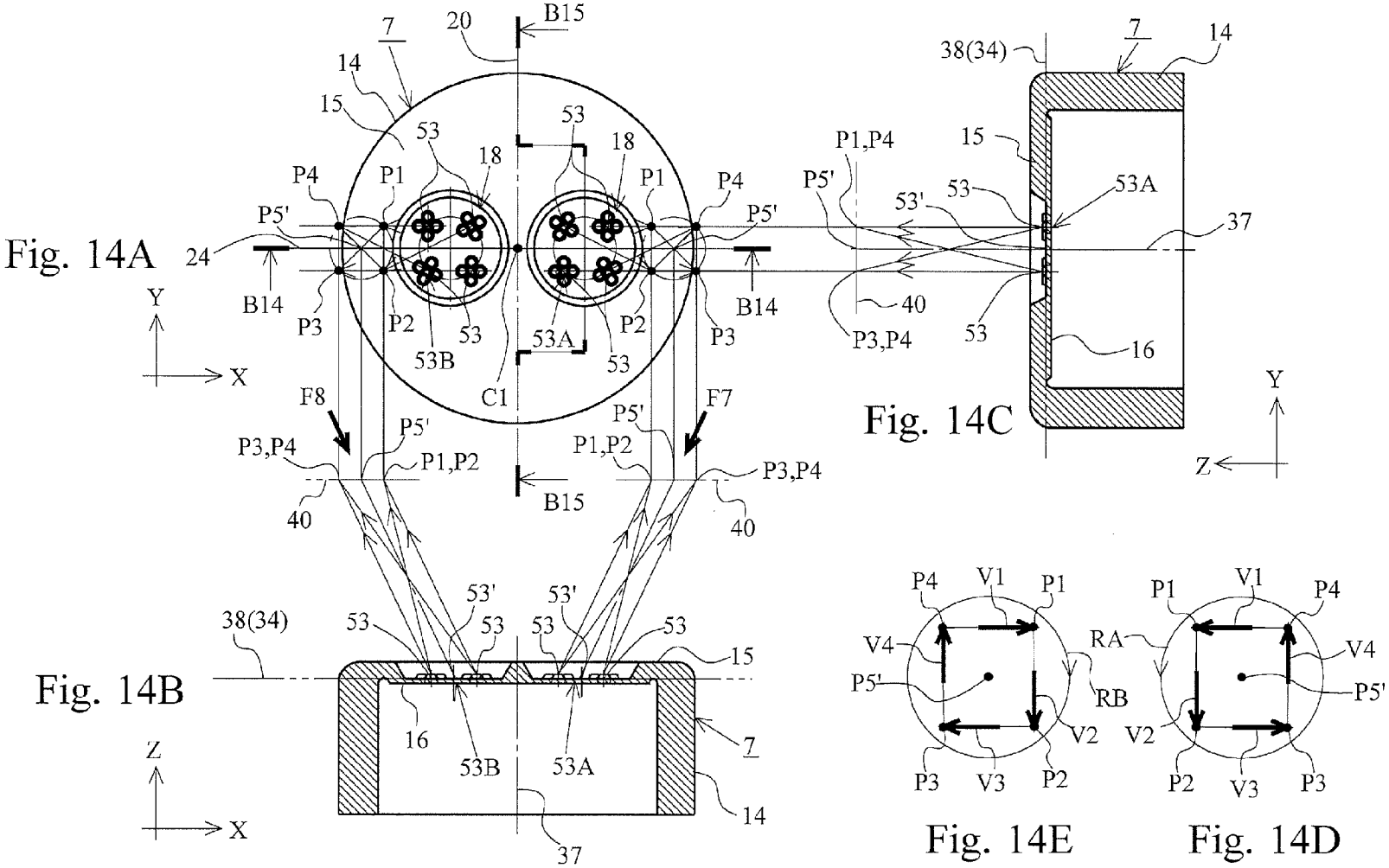
FIGS. 14*a*-14*e* illustrate the fuel injection state of the nozzle plate according to the modification of the second embodiment of the invention and schematically illustrates the fuel injection state of the first orifice group and the fuel injection state of the second orifice group.
Figure 15A:
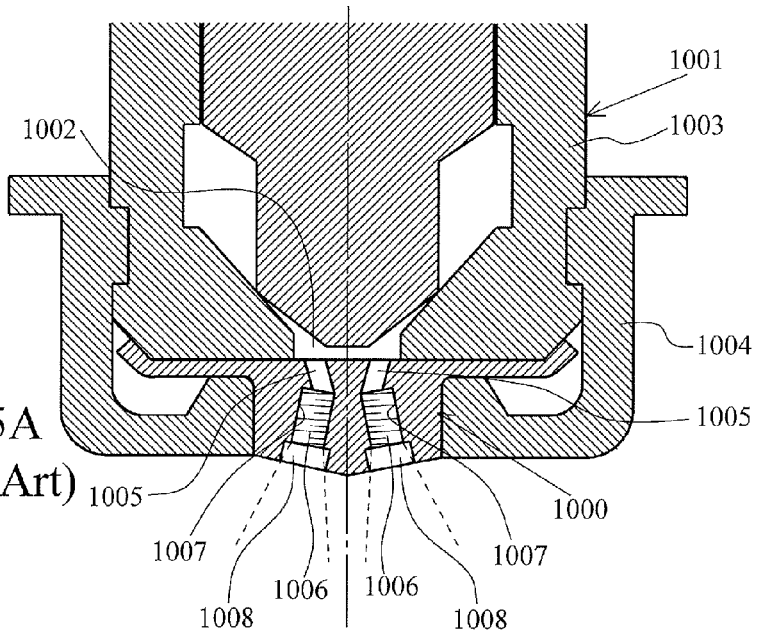
Fig. 15A (Related Art)
FIGS. 15*a*-15*c* illustrate a conventional fuel injection device and nozzle plate.
Figure 15B:
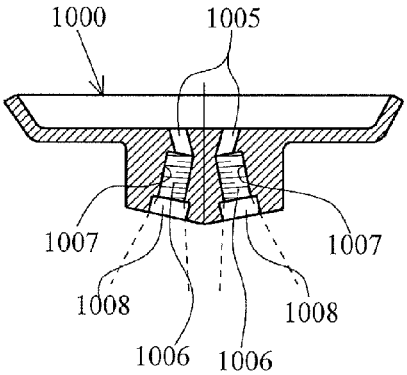
Fig. 15B (Related Art)
Figure 15C:
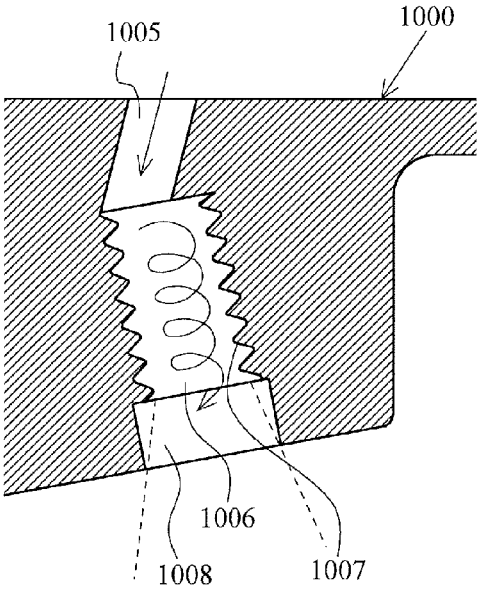
Fig. 15C (Related Art)

The nozzle plate 7 according to the modification will be described with reference to FIG. 13*a* to FIG. 14*e*. FIGS. 13*a*-13*c* illustrate the nozzle plate 7 according to the modification and this drawing corresponds to FIGS. 9*a*-9*c*. In addition, FIGS. 14*a*-14*e* illustrate the fuel injection state of the nozzle plate 7 according to the modification and this drawing corresponds to FIGS. 12*a*-12*c*. In the following descriptions of the nozzle plate 7 according to the modification, duplicate descriptions as in the nozzle plate 7 according to the second embodiment will be omitted as appropriate.

In the nozzle plate 7 according to the modification, the central nozzle holes 12 and the central orifices 53 of the nozzle plate 7 according to the second embodiment are omitted. That is, in the nozzle plate 7 according to the modification, the four nozzle holes 12 are formed at regular intervals around the center C2 of the nozzle hole formation concave portion 18, each of the nozzle holes 12 is partially blocked by the four interference bodies 52, and the orifice 53 is formed for each of the nozzle holes 12.

The first orifice 53 is formed so that the center of the spray reaches the point P1 on the virtual spray reach plane 40. In addition, the second orifice 53 is formed so that the center of the spray reaches the point P2 on the virtual spray reach plane 40. In addition, the third orifice 53 is formed so that the center of the spray reaches the point P3 on the virtual spray reach plane 40. In addition, the fourth orifice 53 is formed so that the center of the spray reaches the point P4 on the virtual spray reach plane 40. The straight lines connecting the point P1, the point P2, the point P3, and the point P4 in this order on the virtual spray reach plane 40 form a rectangle. The points P1 to P4 in the modification match the points P1 to P4 in the nozzle plate 7 according to the second embodiment. In addition, in the nozzle plate 7 according to the modification, a virtual central orifice 53' corresponding to the central orifice 53 of the nozzle plate 7 according to the second embodiment is assumed and the virtual fuel injection direction of the virtual central orifice 53' is assumed to match the fuel injection direction (the central direction of the spray toward the intake ports 4 of the cylinder 5) of the central orifice 53 of the nozzle plate 7 according to the second embodiment. In addition, the crossing point between the virtual fuel injection direction and the virtual spray reach plane 40 is assumed to be P5'.

In addition, as illustrated in FIG. 14(*d*), when the virtual spray reach plane 40 is seen from the direction indicated by arrow F7, which is opposite to the virtual fuel injection direction of the virtual central orifice 53', the velocity component at the center of the spray from the first orifice 53 is the first velocity component V1 from the point P4 to the point P1, the velocity component at the center of the spray from the second orifice 53 is the second velocity component V2 from the point P1 to the point P2, the velocity component at the center of the spray from the third orifice 53 is the third velocity component V3 from the point P2 to the point P3, and the velocity component at the center of the spray from the fourth orifice 53 is the fourth velocity component V4 from the point P3 to the point P4. These first to fourth velocity components V1 to V4 are velocity components in the counterclockwise direction (RA direction) around the point P5'. The atomized droplets (fuel fine particles) in the sprays injected from the first to fourth orifices 53 have kinetic momentum including the counterclockwise (RA direction) velocity component and the velocity component along the virtual fuel injection direction of the virtual central orifice 53', draw ambient air, and provide the drawn air with the kinetic momentum. The air having obtained the kinetic momentum from the droplets (fuel fine particles) in the sprays from the orifices 53 interacts with adjacent sprays, changes to a counterclockwise (RA direction) spiral flow around the virtual fuel injection direction of the virtual central orifice 53', and conveys the droplets (fuel fine particles) toward the intake ports 4 of the cylinder 5. Then, the droplets (fuel fine particles) in the sprays are conveyed by the helical air flow and the droplets are prevented from scattering peripherally. Accordingly, the nozzle plate 7 according to the modification can reduce the amount of fuel adhering to the wall surface of the intake pipe 2 as in the nozzle plate 7 according to the second embodiment, thereby improving the utilization efficiency of fuel.

As described above, the first orifice group 53A spirally drives the sprays counterclockwise (RA direction) (see FIG. 14(*d*)). In contrast, the second orifice group 53B spirally drives the sprays clockwise (RB direction) (see FIG. 14(*e*)). As a result, the rotation of the sprays from the first orifice group 13A and the rotation of the sprays from the second orifice group 13B do not weaken each other.

Other Embodiments

In addition, in the nozzle plate 7 according to the invention, the interference bodies 22 or 52 and the orifices 13 or 53 illustrated in the above embodiments and the above modifications do not need to be used as long as the fuel injection state illustrated in FIGS. 5*a*-5*e*, FIGS. 8*a*-8*e*, FIGS. 11*a*-11*e*, and FIGS. 14*a*-14*e* can be achieved. For example, the nozzle plate 7 according to the invention may have the shapes of the interference bodies and the orifices proposed in the patent applications (Japanese Patent Application No. 2013-256822 and Japanese Patent Application No. 2013-256869) by the applicant of this application. In the nozzle plate 7 according to the invention, the nozzle hole 12 does not need to be partially blocked by a plurality of interference bodies and the nozzle hole 12 may be partially blocked by a single interference body.

In addition, the injection molding of the nozzle plate 7 according to the invention does not need to use synthetic resin (for example, PPS, PEEK, POM, PA, PES, PEI, or LCP) and may use metal powder.

In addition, the invention may be applied to not only the nozzle plate 7 used for the fuel injection device 1 for a 4-valve engine, but also the nozzle plate 7 used for the fuel injection device 1 for a 2-valve engine and the nozzle plate 7 used for the fuel injection device 1 for a 5-valve engine. That is, in the nozzle plate 7 used for the fuel injection device 1 for a 2-valve engine, only one nozzle hole formation concave portion 18 is formed so as to correspond to the disposition of the intake valve 3 and an orifice group including the plurality of orifices 13 and 53 is formed in the nozzle hole formation concave portion 18. In addition, in the nozzle plate 7 used for the fuel injection device 1 for a 5-valve engine, the three nozzle hole formation concave portions 18 are formed so as to correspond to the disposition of the three intake valves 3 and an orifice group including the plurality of orifices 13 or 53 is formed for each of the three nozzle hole formation concave portions 18.

In addition, the invention is not limited to the above embodiments and the above modifications, the first orifice group 13A or 53A may generate a clockwise spiral air flow and the second orifice group 13B or 53B may generate a counterclockwise spiral air flow.

In addition, the invention is not limited to the above embodiments and the above modifications in which the four nozzle holes 12 and the four orifices 13 or 53 are formed at regular intervals around the center C2 of the nozzle hole formation concave portion 18. The two nozzle holes 12 and the two orifices 13 or 53 may be formed around the center C2 of the nozzle hole formation concave portion 18 and a helical air flow toward the intake ports 4 may be generated by interactions between the sprays from the orifices 13 or 53.

In addition, in the above embodiments and the above modifications, the four nozzle holes 12 and the four orifices 13 or 53 are formed around the center C2 of the nozzle hole formation concave portion 18 and a closed rectangle is configured by the first to fourth velocity components V1 to V4 at the centers of sprays from the orifices 13 or 53 on the virtual spray reach plane 40. However, the invention is not limited to the above embodiments and the above modifications. That is, in the invention, the three or more nozzle holes 12 and orifices 13 or 53 may be formed at regular or irregular intervals around the center C2 of the nozzle hole formation concave portion 18, a closed rectangle may be configured by the velocity components at the centers of the sprays from the orifices 13 or 53 on the virtual spray reach plane 40 and a helical air flow toward the intake ports 4 may be generated by interactions between the sprays from the orifices 13 or 53.

REFERENCE SIGNS LIST

1: fuel injection device
2: intake pipe
7: nozzle plate (fuel injection device nozzle plate)
8: fuel injection port
12: nozzle hole
13, 53: orifice
22, 52: interference body
26: outlet side opening
41, 61: injection molding die (die)
46, 66: cavity

The invention claimed is:

1. A fuel injection device nozzle plate to be attached to a fuel injection port of a fuel injection device, the nozzle plate comprising:

a portion facing the fuel injection port and having a plurality of nozzle holes through which fuel injected from the fuel injection port passes, the plurality of nozzle holes facing the fuel injection port, the nozzle holes being configured to inject the fuel from the fuel injection port into an intake pipe through outlet side openings of the nozzle holes; and a plurality of interference bodies partially blocking the outlet side openings to determine injection directions of the fuel, the interference bodies being arranged to form a plurality of orifices for reducing flows of the fuel at the outlet side openings of the nozzle holes, wherein the portion having the nozzle holes and the interference bodies is configured so that the plurality of orifices each have a different fuel injection direction, and so that sprays from adjacent orifices interact with each other to generate a helical air flow, wherein the portion facing the fuel injection port, the nozzle holes, and the interference bodies are formed of the same material and have a one-piece construction, wherein the outlet side openings of the plurality of nozzle holes are positioned on a virtual reference plane orthogonal to a central axis of the fuel injection port, wherein the plurality of nozzle holes include a central nozzle hole and four nozzle holes including first to fourth nozzle holes formed at regular intervals around the central nozzle hole, wherein the plurality of orifices include a central orifice formed in the central nozzle hole and first to fourth orifices formed in the first to fourth nozzle holes, respectively, and wherein the plurality of orifices are configured such that, when a virtual plane that is reached by sprays from the central orifice and the first to fourth orifices and is parallel to the virtual reference plane is assumed to be a virtual spray reach plane, each of fine particles of the fuel at centers of all sprays from the first to fourth orifices having reached the virtual spray reach plane has a velocity component in either a clockwise direction or a counterclockwise direction around an intersecting point between a center of the spray from the central orifice and the virtual spray reach plane.

2. The fuel injection device nozzle plate according to claim 1, wherein the interference bodies are configured to collide with a part of the fuel passing through the nozzle holes, to atomize the part of the fuel passing through the nozzle holes, to steeply bend a flow of the part of the fuel passing through the nozzle holes, to cause the bent flow to collide with the fuel attempting to go straight through the nozzle holes and the orifices, and to disturb the flow of the fuel so that the fuel having passed through the orifices is easily atomized in air, wherein each of the orifices has an acute and sharp corner portion without roundness in a part of an opening edge, and wherein the orifices are configured such that the corner portion of each of the orifices makes an end part of a liquid film of the fuel passing through the orifices acute and sharp so that the fuel is easily atomized by friction with air.

3. The fuel injection device nozzle plate according to claim 2, wherein the orifices are configured such that the corner portion of each of the orifices is formed by an arc-shaped outer edge part of a respective one of the interference bodies and the arc-shaped outlet side opening of a respective one of the nozzle holes.

4. The fuel injection device nozzle plate according to claim 2, wherein the orifices are configured such that the corner portion of each of the orifices is formed by a linear outer edge part of a respective one of the interference bodies and the arc-shaped outlet side opening of a respective one of the nozzle holes.

5. The fuel injection device nozzle plate according to claim 2, wherein each of the interference bodies has an arc-shaped outer edge part forming a part of the opening edge of a respective one of the orifices, and the orifices are configured such that the corner portion of each of the orifices is formed in an abutting part of the arc-shaped outer edge parts of adjacent interference bodies.

6. The fuel injection device nozzle plate according to claim 2, wherein each of the interference bodies has a linear outer edge part forming a part of the opening edge of a respective one of the orifices, and the orifices are configured such that the corner portion of each of the orifices is formed in an abutting part of the linear outer edge parts of adjacent interference bodies.

7. The fuel injection device nozzle plate according to claim 1, wherein the portion is a first one of a plurality of portions, each of the portions having a plurality of nozzle holes, each of the nozzle holes of each of the portions having an outlet side opening partially blocked by a plurality of interference bodies.

8. A fuel injection device nozzle plate to be attached to a fuel injection port of a fuel injection device, the nozzle plate comprising:

a portion facing the fuel injection port and having a plurality of nozzle holes through which fuel injected from the fuel injection port passes, the plurality of nozzle holes facing the fuel injection port, the nozzle holes being configured to inject the fuel from the fuel injection port into an intake pipe through outlet side openings of the nozzle holes; and a plurality of interference bodies partially blocking the outlet side openings to determine injection directions of the fuel, the interference bodies being arranged to form a plurality of orifices for reducing flows of the fuel at the outlet side openings of the nozzle holes, wherein the portion having the nozzle holes and the interference bodies is configured so that the plurality of orifices each have a different fuel injection direction, and so that sprays from adjacent orifices interact with each other to generate a helical air flow, wherein the portion facing the fuel injection port, the nozzle holes, and the interference bodies are formed of the same material and have a one-piece construction, wherein the outlet side openings of the plurality of nozzle holes are positioned on a virtual reference plane orthogonal to a central axis of the fuel injection port, wherein the plurality of nozzle holes are four nozzle holes including first to fourth nozzle holes formed at regular intervals around a virtual central position set on the virtual reference plane, wherein the plurality of orifices include first to fourth orifices formed in the first to fourth nozzle holes, respectively, and wherein the plurality of orifices are configured such that, when a virtual plane that is reached by sprays from the first to fourth orifices and is parallel to the virtual reference plane is assumed to be a virtual spray reach plane, each of fine particles of the fuel at centers of all sprays from the first to fourth orifices having reached the virtual spray reach plane has a velocity component in either a clockwise direction or a counterclockwise direction around a virtual central point set on the virtual spray reach plane.

9. The fuel injection device nozzle plate according to claim 8, wherein the interference bodies are configured to collide with a part of the fuel passing through the nozzle holes, to atomize the part of the fuel passing through the nozzle holes, to steeply bend a flow of the part of the fuel passing through the nozzle holes, to cause the bent flow to collide with the fuel attempting to go straight through the nozzle holes and the orifices, and to disturb the flow of the fuel so that the fuel having passed through the orifices is easily atomized in air, wherein each of the orifices has an acute and sharp corner portion without roundness in a part of an opening edge, and wherein the orifices are configured such that the corner portion of each of the orifices makes an end part of a liquid film of the fuel passing through the orifices acute and sharp so that the fuel is easily atomized by friction with air.

10. The fuel injection device nozzle plate according to claim 9, wherein the orifices are configured such that the corner portion of each of the orifices is formed by an arc-shaped outer edge part of a respective one of the interference bodies and the arc-shaped outlet side opening of a respective one of the nozzle holes.

11. The fuel injection device nozzle plate according to claim 9, wherein the orifices are configured such that the corner portion of each of the orifices is formed by a linear outer edge part of a respective one of the interference bodies and the arc-shaped outlet side opening of a respective one of the nozzle holes.

12. The fuel injection device nozzle plate according to claim 9, wherein each of the interference bodies has an arc-shaped outer edge part forming a part of the opening edge of a respective one of the orifices, and the orifices are configured such that the corner portion of each of the orifices is formed in an abutting part of the arc-shaped outer edge parts of adjacent interference bodies.

13. The fuel injection device nozzle plate according to claim 9, wherein each of the interference bodies has a linear outer edge part forming a part of the opening edge of a respective one of the orifices, and the orifices are configured such that the corner portion of each of the orifices is formed in an abutting part of the linear outer edge parts of adjacent interference bodies.

14. The fuel injection device nozzle plate according to claim 8, wherein the portion is a first one of a plurality of portions, each of the portions having a plurality of nozzle holes, each of the nozzle holes of each of the portions having an outlet side opening partially blocked by a plurality of interference bodies.

* * * * *